US008695541B2

(12) United States Patent
Nishikawa et al.

(10) Patent No.: US 8,695,541 B2
(45) Date of Patent: Apr. 15, 2014

(54) COOLING SYSTEM FOR INTERNAL COMBUSTION ENGINE

(75) Inventors: Michio Nishikawa, Nagoya (JP); Takeo Matsumoto, Kariya (JP); Mitsuo Hara, Ichinomiya (JP); Mitsunobu Uchida, Okazaki (JP)

(73) Assignee: Denso Corporation, Kariya (JP)

( * ) Notice: Subject to any disclaimer, the term of this patent is extended or adjusted under 35 U.S.C. 154(b) by 262 days.

(21) Appl. No.: 13/403,034

(22) Filed: Feb. 23, 2012

(65) Prior Publication Data

US 2012/0210954 A1 Aug. 23, 2012

(30) Foreign Application Priority Data

Feb. 23, 2011 (JP) ..... 2011-37072

(51) Int. Cl.
*F01P 7/14* (2006.01)

(52) U.S. Cl.
USPC ..... 123/41.08

(58) Field of Classification Search
USPC ..... 123/41.08–41.1, 41.29; 236/34.5; 237/34; 60/295, 299
See application file for complete search history.

(56) References Cited

U.S. PATENT DOCUMENTS 6,178,928 B1 * 1/2001 Corriveau ..... 123/41.12
2003/0019442 A1 * 1/2003 Yoshikawa et al. ..... 123/41.1

FOREIGN PATENT DOCUMENTS

JP 2010-163897 7/2010
JP 2010-163920 7/2010

* cited by examiner

*Primary Examiner* — Hung Q Nguyen
(74) *Attorney, Agent, or Firm* — Nixon & Vanderhye PC

(57) ABSTRACT

During engine warm-up, a flow regulating unit in a cooling system operates in a fuel efficiency priority mode. In this mode, a head-side cooling water flow rate (Qhd) is regulated to be equal to or smaller than a first upper limit; a block-side cooling water flow rate (Qbk) is regulated to be equal to or smaller than a second upper limit; and cooling water flowing out of a block-side passage and a head-side passage flows mainly into a bypass passage. When a heating request to heat blown air is made during engine warm-up, the regulating unit operates in a heating priority mode. In this mode, Qhd is regulated to be equal to or smaller than a third upper limit; Qbk is regulated to be equal to or smaller than a fourth upper limit; and at least cooling water flowing out of the head-side passage flows into a heat exchanger.

17 Claims, 13 Drawing Sheets

FUEL EFFICIENCY PRIORITY MODE

HEATING PRIORITY MODE

HEATING PRIORITY MODE

FUEL EFFICIENCY PRIORITY MODE

FUEL EFFICIENCY PRIORITY MODE

FIG. 9

| OPERATING CONDITION | FLOW PASSAGE | HEAD-SIDE OUTLET TEMPERATURE (TWhd) | | |
|---|---|---|---|---|
| | | TW1 OR LOWER | TW1~TW0 | TW0 OR HIGHER |
| OT REGION | FIRST UPPER LIMIT (HEAD-SIDE) | L | L | L |
| | SECOND UPPER LIMIT (BLOCK-SIDE) | M | M | L |
| TK REGION | FIRST UPPER LIMIT (HEAD-SIDE) | M | M | L |
| | SECOND UPPER LIMIT (BLOCK-SIDE) | S | S | S |
| MBT REGION | FIRST UPPER LIMIT (HEAD-SIDE) | VS | S | S |
| | SECOND UPPER LIMIT (BLOCK-SIDE) | VS | VS | S |

FUEL EFFICIENCY PRIORITY MODE

FIG. 10

| OPERATING CONDITION | FLOW PASSAGE | HEAD-SIDE OUTLET TEMPERATURE (TWhd) | | |
|---|---|---|---|---|
| | | TW1 OR LOWER | TW1~TW0 | TW0 OR HIGHER |
| OT REGION | THIRD UPPER LIMIT (HEAD-SIDE) | L | L | L |
| | FOURTH UPPER LIMIT (BLOCK-SIDE) | S | M | L |
| TK REGION | THIRD UPPER LIMIT (HEAD-SIDE) | M | M | L |
| | FOURTH UPPER LIMIT (BLOCK-SIDE) | VS | VS | S |
| MBT REGION | THIRD UPPER LIMIT (HEAD-SIDE) | S | S | S |
| | FOURTH UPPER LIMIT (BLOCK-SIDE) | VS | VS | S |

HEATING PRIORITY MODE

FUEL EFFICIENCY PRIORITY MODE

HEATING PRIORITY MODE

FUEL EFFICIENCY PRIORITY MODE

FUEL EFFICIENCY PRIORITY MODE

ENGINE PERFORMANCE CHARACTERISTIC

COOLING SYSTEM FOR INTERNAL COMBUSTION ENGINE

CROSS REFERENCE TO RELATED APPLICATION

This application is based on Japanese Patent Application No. 2011-37072 filed on Feb. 23, 2011, the disclosure of which is incorporated herein by reference.

TECHNICAL FIELD

The present disclosure relates to a cooling system for an internal combustion engine that cools the engine by circulating cooling water through the engine.

BACKGROUND

There has been known an internal combustion engine cooling system for a vehicle that cools an engine by circulating cooling water in an internal combustion engine (engine) to output a driving force for running a vehicle.

For example, in an internal combustion engine cooling system disclosed in JP-A 2010-163920, a head-side passage that circulates a cooling water for cooling a cylinder head and a block-side passage that circulates a cooling water for cooling a cylinder block are provided in an engine. At the time of warming up the engine, the quick warming-up of the whole of the engine is realized by preventing the cooling water from being circulated in the head-side passage to accelerate increasing the temperature of the cylinder head.

Moreover, in general, the cooling water circulating through this kind of internal combustion engine cooling system is used as a heat source of a heating heat exchanger (heater core) for heating a blowing air blown into a vehicle compartment that is a space to be air-conditioned in an air conditioner for a vehicle.

Thus, in an internal combustion engine cooling system for a vehicle disclosed in JP-A 2010-163897, when a request of heating a vehicle compartment is made while the engine is warmed up, the heating of the vehicle compartment is realized by guiding the cooling water flowing out of the head-side passage into the heater core and further by making the cooling water flowing out of the heater core bypass the block-side passage and flow into the head-side passage.

However, in the internal combustion engine cooling system disclosed in JP-A 2010-163920, when a heating request is made at the time of warming up the engine, the cooling water flowing out of the block-side passage needs to be made to flow into the heater core, which results in delaying the warming-up of the cylinder block side. Thus, this delays the warming-up of a portion (liner portion) of a cylinder in a cylinder block that slides on a piston to cause an impairment in fuel efficiency by a friction loss.

Further, in the internal combustion engine cooling system disclosed in JP-A 2010-163897, the cooling water flowing out of the head-side passage is supplied to the heater core, so that in order to secure a heat quantity to sufficiently heat the blowing air, the flow rate of the head-side cooling water circulating through the head-side passage needs to be increased. However, when the flow rate of the head-side cooling water circulating through the head-side passage is increased, the temperature of the cooling water flowing out of the head-side passage is made lower. Thus, the temperature of the blowing air cannot be sufficiently raised and hence quick heating cannot be realized.

SUMMARY

According to the present disclosure, there is provided a cooling system for cooling an internal combustion engine by a flow of cooling water through the engine such that temperature of the engine in normal operation falls within a predetermined temperature range. At least a part of cooling water is used for a heat source for heating air blown toward an air-conditioning target space. The engine includes a cylinder block, a block-side passage through which cooling water for cooling the cylinder block flows, a cylinder head, and a head-side passage through which cooling water for cooling the cylinder head flows. The cooling system includes a cooling water pressure-feeding unit, a heating heat exchanger, a radiating heat exchanger, a bypass passage, and a flow regulating unit. The cooling water pressure-feeding unit is configured to pressure-feed cooling water into the block-side passage and the head-side passage. The heating heat exchanger is configured to exchange heat between cooling water flowing out from at least one of the block-side passage and the head-side passage, and the blown air. The radiating heat exchanger is configured to exchange heat between cooling water flowing out of the block-side passage and the head-side passage, and outside air, so that cooling water radiates heat. The bypass passage guides cooling water flowing out of the block-side passage and the head-side passage to bypass the heating heat exchanger and the radiating heat exchanger and to flow into a suction side of the cooling water pressure-feeding unit. The flow regulating unit is configured to regulate at least one of a block-side cooling water flow rate, which is a flow rate of cooling water flowing through the block-side passage, and a head-side cooling water flow rate, which is a flow rate of cooling water flowing through the head-side passage. At a time of warm-up of the engine, the flow regulating unit is configured to operate in a fuel efficiency priority mode. In the fuel efficiency priority mode, the flow regulating unit regulates the head-side cooling water flow rate to be equal to or smaller than a first upper limit, which is equal to or smaller than the head-side cooling water flow rate when the engine is in the normal operation; the flow regulating unit regulates the block-side cooling water flow rate to be equal to or smaller than a second upper limit, which is equal to or smaller than the first upper limit; and the flow regulating unit regulates the flow of cooling water such that cooling water flowing out of the block-side passage and the head-side passage flows mainly into the bypass passage. When a heating request to heat the blown air by the heating heat exchanger is made at the time of warm-up of the engine, the flow regulating unit is configured to operate in a heating priority mode. In the heating priority mode, the flow regulating unit regulates the head-side cooling water flow rate to be equal to or smaller than a third upper limit, which is equal to or smaller than the head-side cooling water flow rate when the engine is in the normal operation and higher than the first upper limit; the flow regulating unit regulates the block-side cooling water flow rate to be equal to or smaller than a fourth upper limit, which is equal to or smaller than the third upper limit; and the flow regulating unit regulates the flow of cooling water such that at least cooling water flowing out of the head-side passage flows into the heating heat exchanger.

BRIEF DESCRIPTION OF THE DRAWINGS

The above and other objects, features and advantages of the present disclosure will become more apparent from the following detailed description made with reference to the accompanying drawings. In the drawings:

FIG. 9 is a diagram to show first upper limits and second upper limits according to an operating condition of an engine at the time of the fuel efficiency priority mode of a fourth embodiment;

FIG. 10 is a diagram to show third and fourth upper limits according to an operating condition of an engine at the time of the heating priority mode of the fourth embodiment;

DETAILED DESCRIPTION

First Embodiment

Figure 1:
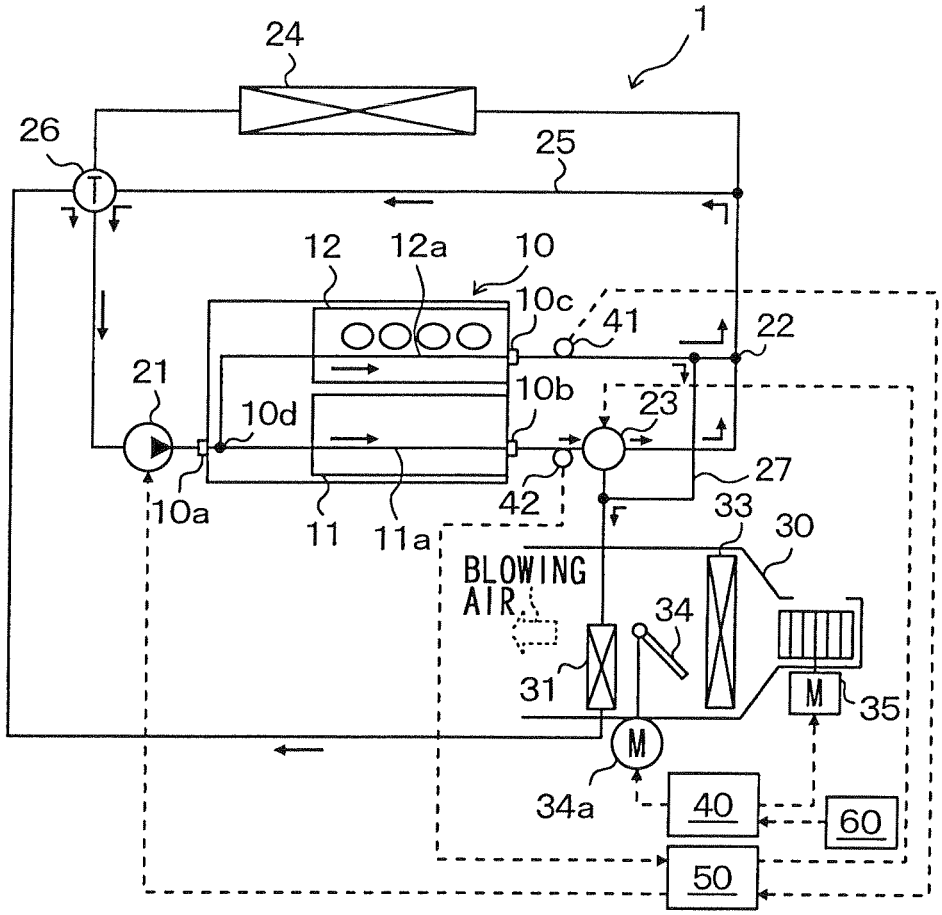
FIG. 1 is a general construction view to show a fuel efficiency priority mode of an internal combustion engine cooling system of a first embodiment.
Figure 2:
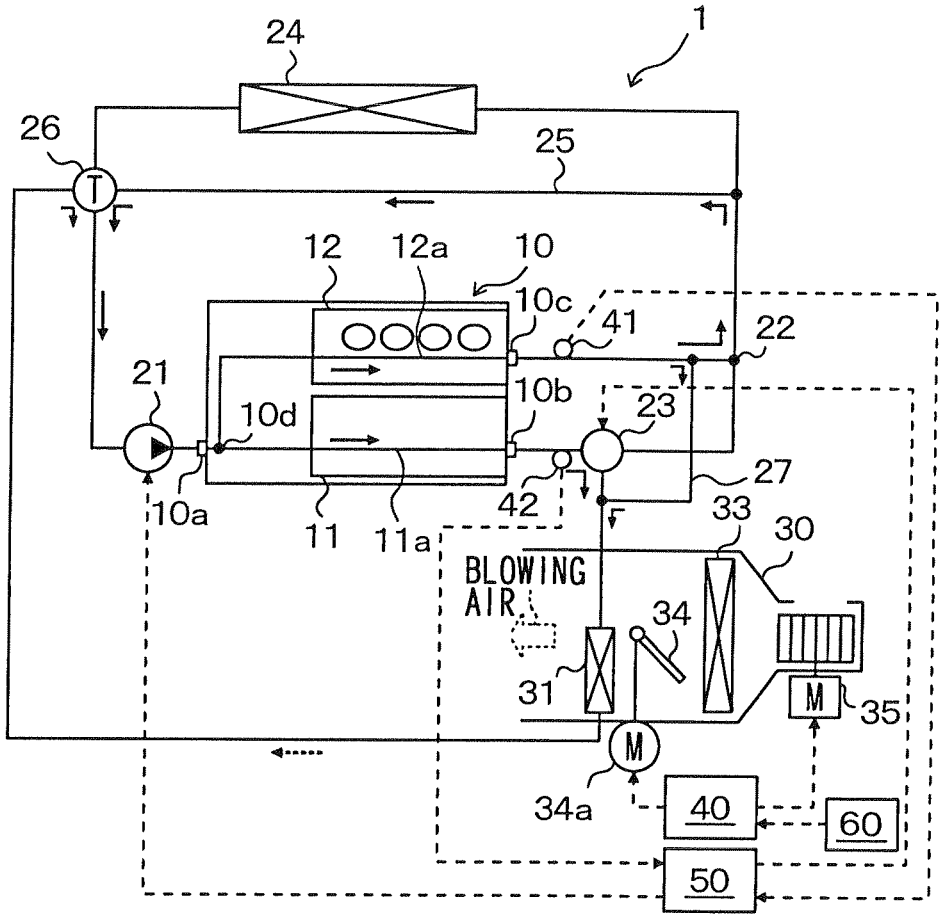
FIG. 2 is a general construction view to show a heating priority mode of the internal combustion engine cooling system of the first embodiment.

A first embodiment will be described with reference to FIG. 1 to FIG. 6. FIG. 1 and FIG. 2 are general construction views of an internal combustion engine cooling system 1 of the present embodiment. In the present embodiment, this internal combustion engine cooling system 1 is applied to a so-called hybrid vehicle that acquires a driving force for running a vehicle from an internal combustion engine (engine) 10 and an electric motor for running. Thus, the internal combustion engine cooling system 1 of the present embodiment performs a function of cooling the engine 10 of the hybrid vehicle.

Specifically, the internal combustion engine cooling system 1 circulates cooling water through cooling water passages 11*a*, 12*a* formed in the engine 10 to thereby cool the engine 10. Further, this cooling water is used also as a heat source for heating that heats blowing air blown into a vehicle compartment of a space to be air-conditioned in an air conditioner for a vehicle. For this cooling water, for example, an ethylene glycol water solution can be employed.

Moreover, the internal combustion engine cooling system 1 of the present embodiment is constructed in the following manner: that is, when the engine 10 is warmed up, the internal combustion engine cooling system 1 is operated in a fuel efficiency priority mode (FIG. 1) for accelerating the warming-up of the engine 10 without impairing a fuel efficiency of a vehicle, whereas when the engine 10 is warmed up and a request of heating a vehicle compartment is made, the internal combustion engine cooling system 1 is operated in a heating priority mode (FIG. 2) for realizing the quick heating of the vehicle compartment. The operation of the internal combustion engine cooling system 1 in the fuel efficiency priority mode and in the heating priority mode will be described later.

Further, as to the engine 10 of the hybrid vehicle to which the internal combustion engine cooling system 1 of the present embodiment is applied, a gasoline engine constructed of a cylinder block 11 and a cylinder head 12 is adopted.

The cylinder block 11 is a metal block body that forms a cylinder in which a piston is reciprocated and that has a crankcase provided below the cylinder in a state where the cylinder block 11 is mounted in the vehicle, the crankcase having a crankshaft, a connecting rod for connecting the piston to the crankshaft, and the like received therein. The cylinder head 12 is a metal block body that closes an opening formed on the top dead center side of the cylinder to thereby form a combustion chamber together with the cylinder and the piston.

Still further, in this engine 10, the cylinder block 11 is integrally combined with the cylinder head 12, whereby a block-side passage (block-side water jacket) 11*a* for circulating the cooling water for cooling the cylinder block 11 and a head-side passage (head-side water jacket) 12*a* for circulating the cooling water for cooling the cylinder head 12 are formed in the engine 10.

An inlet side of the block-side passage 11*a* and an inlet side of the head-side passage 12*a* are connected to each other at a branch part 10*d* arranged in the engine 10, and this branch part 10*d* communicates with an inflow port 10*a* through which the cooling water is made to flow into the engine 10 from the outside of the engine 10. An outlet side of the block-side passage 11*a* and an outlet side of the head-side passage 12*a* communicate with a block-side outflow port 10*b* and a head-side outflow port 10*c* through which the cooling water is made to flow out of the engine 10, respectively.

The inflow port 10*a* of the engine 10 has a discharge port of a water pump 21 connected thereto. The water pump 21 is a cooling water pressure-feeding unit for pressure-feeding the cooling water to the block-side passage 11*a* and the head-side passage 12*a* in the internal combustion engine cooling system 1.

More specifically, the water pump 21 is an electric pump for driving an impeller, which is arranged in a casing to form a pump chamber, by an electric motor. In this regard, the electric motor of this water pump 21 has the number of revolutions (capacity of pressure-feeding the cooling water) controlled by a control voltage outputted from an engine control device 50 which will be described later.

On the other hand, the block-side outflow port 10*b* and the head-side outflow port 10*c* have a joining part 22 that makes the cooling water flowing out of the block-side passage 11*a* join the cooling water flowing out of the head-side passage 12*a* to make the joined cooling water flow out to a cooling water inlet side of a radiator 24 which will be described later. Further, a cooling water passage extending from the block-side outflow port 10*b* to the joining part 22 has a flow regulating valve 23 arranged therein.

The flow regulating valve 23 performs a function of regulating the flow rates of the cooling water made to flow out to the joining part 22 (bypass passage 25, which will be described later) side and the cooling water made to flow out to the cooling water inlet side of a heater core 31, which will be described later, of the cooling water flowing out of the block-side passage 11*a*.

More specifically, the flow regulating valve 23 is constructed in such a way as to regulate a passage cross-sectional area of the cooling water passage, which connects the block-side outflow port 10*b* to the joining part 22, and a passage cross-sectional area of the cooling water passage, which connects the block-side outflow port 10*b* to the cooling water inlet side of the heater core 31, independently of each other. This construction can be realized by a construction of combining a plurality of linear solenoid valves.

Further, the flow regulating valve 23 regulates the passage cross-sectional area of the cooling water passage which connects the block-side outflow port 10*b* to the joining part 22, thereby being able to change also the ratio between a block-side cooling water flow rate Qbk circulating through the block-side passage 11*a* and a head-side cooling water flow rate Qhd circulating through the head-side passage 12*a*. Thus, the flow regulating valve 23 of the present embodiment constructs a flow rate regulation unit for regulating the block-side cooling water flow rate Qbk and the head-side cooling water flow rate Qhd.

Still further, a cooling water passage extending from the head-side outflow port 10*c* to the joining part 22 has a head-side bypass passage 27 connected thereto, the head-side bypass passage 27 branching the flow of the cooling water flowing out of the head-side passage 12*a* and guiding the branched flow to a cooling water inlet side of the heater core 31. Thus, irrespective of the operating mode of the internal combustion engine cooling system 1, at least a portion of the cooling water flowing out of the head-side passage 12*a* flows into the heater core 31 of the present embodiment.

The heater core 31 is a heating heat exchanger that is arranged in a casing 30 of an indoor air-conditioning unit that forms an air passage of the blowing air in the air conditioner for a vehicle and that exchanges heat between the cooling water circulating in itself and the blowing air to heat the blowing air. Further, the cooling water outlet side of the heater core 31 is connected to the suction port side of the water pump 21 via a thermostat 26 which will be described later.

The cooling water outlet side of the joining part 22 has the cooling water inlet side of a radiator 24 connected thereto. The radiator 24 is a radiating heat exchanger that exchanges heat between the cooling water flowing out of the block-side passage 11*a* and the cooling water flowing out of the head-side passage 12*a* and the outside air to radiate the heat quantity held by the cooling water to the outside air. The cooling water outlet side of the radiator 24 is connected to the suction port side of the water pump 21 via the thermostat 26.

Furthermore, the internal combustion engine cooling system 1 of the present embodiment has a bypass passage 25 that makes the cooling water flowing out of the joining part 22 bypass the radiator 24 and the heater core 31 to guide the cooling water to the suction side of the water pump 21. The outlet side of this bypass passage 25 is also connected to the suction port side of the water pump 21 via the thermostat 26.

The thermostat 26 is a combination type valve responding to a cooling water temperature, which displaces a plurality of valve bodies by a thermo-wax (temperature sensing member), whose volume is changed by temperature, to change the openings (cross-sectional areas) of a plurality of cooling water passages at the same time.

More specifically, the thermostat 26 has three cooling water passages of a radiator-side cooling water passage that connects the cooling water outlet side of the radiator 24 to the suction port side of the water pump 21, a bypass passage side cooling water passage that connects the outlet side of the bypass passage 25 to the suction port side of the water pump 21, and a heater core side cooling water passage that connects the cooling water outlet side of the heater core 31 to the suction port side of the water pump 21.

Furthermore, the thermostat 26 is constructed of a first valve body, which changes the opening of the radiator side cooling water passage and the opening of the bypass passage side cooling water passage, and a second valve body, which changes the opening of the heater core side cooling water passage.

As the temperature of the cooling water circulating in the thermostat 26 is raised to increase the volume of the thermo-wax, the first valve body is displaced in such a way as to increase the opening of the radiator side cooling water passage and to decrease the opening of the bypass passage side cooling water passage. On the contrary, as the temperature of the cooling water circulating in the thermostat 26 is lowered to decrease the volume of the thermo-wax, the first valve body is displaced in such a way as to decrease the opening of the radiator side cooling water passage and to increase the opening of the bypass passage side cooling water passage.

Thus, as the temperature of the cooling water is raised, the quantity of heat that the cooling water in the radiator 24 radiates to the outside air is increased, whereas as the temperature of the cooling water is lowered, the quantity of heat that the cooling water in the radiator 24 radiates to the outside air is decreased. In this way, the temperature of the cooling water flowing out of the thermostat 26 can be brought close to a predetermined inflow-side base temperature Turin (65° C. in the present embodiment).

As the temperature of the cooling water circulating in the thermostat 26 is lowered to decrease the volume of the thermo-wax, the second valve body is displaced in such a way as to decrease the opening of the heater core side cooling water passage. Moreover, the second valve body has its operation range regulated in such a way as not to completely close the heater core side cooling water passage.

Thus, even if the temperature of the cooling water is not sufficiently raised, for example, at the time of warming up the engine 10, the cooling water can be made to flow into the heater core 31 and further as the temperature of the cooling water is lowered, the quantity of cooling water flowing into the heater core 31 can be also reduced (decreased).

Next, the air conditioner for a vehicle of the present embodiment will be described. The air conditioner for a vehicle of the present embodiment is a so-called air-mixing type air conditioner that regulates a mixing ratio between cool air cooled by a cooling heat exchanger (in this embodiment, an evaporator 33 of a vapor compression type refrigeration cycle) arranged in the casing 30 and hot air heated by the heater core 31 by an air mixing door 34 to thereby regulate the temperature of the blowing air blown into the vehicle compartment.

The air mixing door 34 is driven by an electric actuator 34*a* for an air mixing door, and this electric actuator 34*a* has its operation controlled by a control signal outputted from an air-conditioning control device 40. Further, a blower 35 for blowing air into the vehicle compartment is arranged on the most upstream side of the air passage in the casing 30. This air blower 35 also has its number of revolutions (the quantity of blowing air) controlled by a control signal outputted from the air-conditioning control device 40.

Next, the engine control device 50 and the air conditioning control device 40 will be described. Each of the engine control device 50 and the air conditioning control device 40 is constructed of a well-known microcomputer including a CPU, a ROM, and a RAM and its peripheral circuit. The engine control device 50 and the air conditioning control device 40 perform various calculations and processings on the basis of control programs stored in this ROM to thereby control the operations of various kinds of units connected to their output sides.

Specifically, to the output side of the engine control device 50 are connected a starter for starting the engine 10, a drive circuit of a fuel injection valve (injector) for injecting and feeding fuel into the engine 10, an electric motor of the water pump 21, and the like.

On the other hand, to the input side of the engine control device 50 are connected a group of sensors for controlling the engine that include an engine rotating speed sensor for detecting an engine rotating speed Ne, a vehicle speed sensor for detecting a vehicle speed Vv, a head-side thermistor 41 for detecting the temperature of the cooling water flowing out of the head-side passage 12*a* (hereinafter referred to as a head-side outlet temperature TWhd), a block-side thermistor 42 for detecting the temperature of the cooling water flowing out of the block-side passage 11*a* (hereinafter referred to as a block-side outlet temperature TWbk), and the like.

Moreover, to the output side of the air conditioning control device 40 are connected an electric actuator for the air mixing door, the blower 35, and various kinds of constituent units constructing the vapor compression type refrigeration cycle. On the other hand, to the input side of the air conditioning control device 40 are connected a group of sensors for air conditioning control that include an inside air temperature sensor for detecting an inside air temperature Tr in the vehicle compartment, an outside air temperature sensor for detecting an outside air temperature Tam, an insolation sensor for detecting an insolation quantity Ts in the vehicle compartment, and an evaporator temperature sensor for detecting the temperature of the air blown out of an evaporator 33 (refrigerant evaporation temperature) Te.

Further, to the input side of the air conditioning control device 40 are connected an operation panel 60 arranged in the vehicle compartment. This operation panel 60 has a switch for activating the air conditioner for a vehicle, a switch for setting temperature in the vehicle compartment, a heating switch for selecting whether an occupant (user) heats the vehicle compartment or not (heating request input unit), and the like.

In addition, the engine control device 50 and the air conditioning control device 40 of this embodiment are electrically connected to each other and are constructed so as to communicate with each other. In this way, on the basis of a detection signal or an operation signal inputted to one control device, the other control device can also control the operations of various units connected to its output side. Thus, the engine control device 50 and the air conditioning control device 40 may be integrally constructed as one control device.

Moreover, each of the engine control device 50 and the air conditioning control device 40 is a device in which control means for controlling various kinds of units connected to its output side are integrally constructed, and of the engine control device 50 and the air conditioning control device 40, a construction (hardware and software) of controlling the operation of each unit to be controlled constructs a control means of the unit to be controlled.

For example, in this embodiment, of the engine control device 50, a construction (hardware and software) of controlling the operation of the electric motor for controlling the capacity of pressure-feeding the cooling water of the water pump 21 constructs a pressure-feeding capacity control means, whereas a construction (hardware and software) of controlling the operation of the flow regulating valve 23 constructs a flow regulating valve control means.

Next, the operation of the present embodiment in the construction described above will be described. First, the basic operation of the engine 10 will be described. When a vehicle start switch is turned on to start the vehicle, the engine control device 50 reads detection signals of the group of various kinds of sensors for controlling the engine, which are connected to its input side, and calculates a running load of the vehicle on the basis of the read detection values. Further, the engine control device 50 activates or stops the engine 10 according to the calculated running load.

Thereafter, the engine control device 50 repeats a control routine of reading the detection signal, calculating the running load, and controlling the operation of the engine in this order at a predetermined control period until the vehicle is brought into a stop state by a vehicle stop switch.

In this way, the hybrid vehicle can switch between a running state referred to as a so-called HV running, in which the vehicle acquires the driving force from both of the engine 10 and the electric motor for running and runs, and another running state referred to as a so-called EV running, in which the vehicle has its engine stopped and acquires the driving force from only the electric motor for running and runs. As a result, the hybrid vehicle can improve the fuel efficiency as compared with a conventional vehicle having only the engine 10 as a driving source for running the vehicle.

Next, the basic operation of the air conditioner for a vehicle will be described. When the switch of activating the air conditioner for a vehicle is turned on in the state where a vehicle start switch is set, the air conditioning control device 40 reads the detection signals of the group of sensors for the air conditioning control and the operation signals of the operation panel 60. The air conditioning control device 40 calculates a target blowoff temperature TAO of a target temperature of the air blown off into the vehicle compartment on the basis of the values of the detection signals and the operation signals.

Further, the air conditioning control device 40 determines the operating conditions of the various kinds of air conditioning control units connected to the output side of the air conditioning control device 40 on the basis of the calculated target blowoff temperature TAO and the detection signals of the group of sensors.

For example, a target quantity of blowing air of the blower 35, that is, a control voltage outputted to the electric motor of the blower 35 is determined to be higher when the target blowoff temperature TAO is set at a higher value and a lower value than when the target blowoff temperature TAO is set at a middle value with reference to a control map stored previously in the air conditioning control device 40 on the basis of the target blowoff temperature TAO.

Still further, in this embodiment, when the head-side outlet temperature TWhd is equal to or less than a heating start temperature TW1 (in this embodiment, 40° C.) at the time of heating, the blowing capacity of the blower 35 is set to 0, that is, the operation of the blower 35 is stopped. This can prevent the blowing air, which is not sufficiently heated by the heater core 31 at the time of heating, from being blown out into the vehicle compartment.

Moreover, a control signal outputted to the electric actuator 34*a* of the air mixing door 34 is determined by the use of the target blowoff temperature TAO, the detection value of the temperature Te of the air blown out of the evaporator 33, and the detection value of the head-side thermistor 41 in such a way that the temperature of the air blown out into the vehicle compartment becomes a temperature desired and set by an occupant by the use of a temperature setting switch.

In addition, when the occupant selects to heat the vehicle compartment by a heating switch, the opening of the air mixing door 34 may be controlled in such a way that the total quantity of blowing air blown from the blower 35 passes through the heater core 31. Further, the operation of the compressor of the refrigeration cycle may be stopped.

Then, the air conditioning control device 40 outputs the control voltage and the control signal, which are determined in the manner described above, to various kinds of air conditioning control units. Thereafter, until the operation of the air conditioner for a vehicle is required to be stopped by the operation panel 60, at a predetermined control period, the air conditioning control device 40 repeats the control routine of reading the detection signal and the operation signal, calculating the target blowoff temperature TAO, determining the operating condition of various kinds of air conditioning units, and outputting the control voltage and the control signal in this order.

In this way, in the air conditioner for a vehicle, the blowing air blown from the blower 35 is cooled by the evaporator 33 and a portion of the cooled blowing air is reheated by the heater core 31, whereby the blowing air (conditioned air), which is brought to the temperature desired by the occupant, is blown into the vehicle compartment to air-condition the vehicle compartment.

Figure 4:
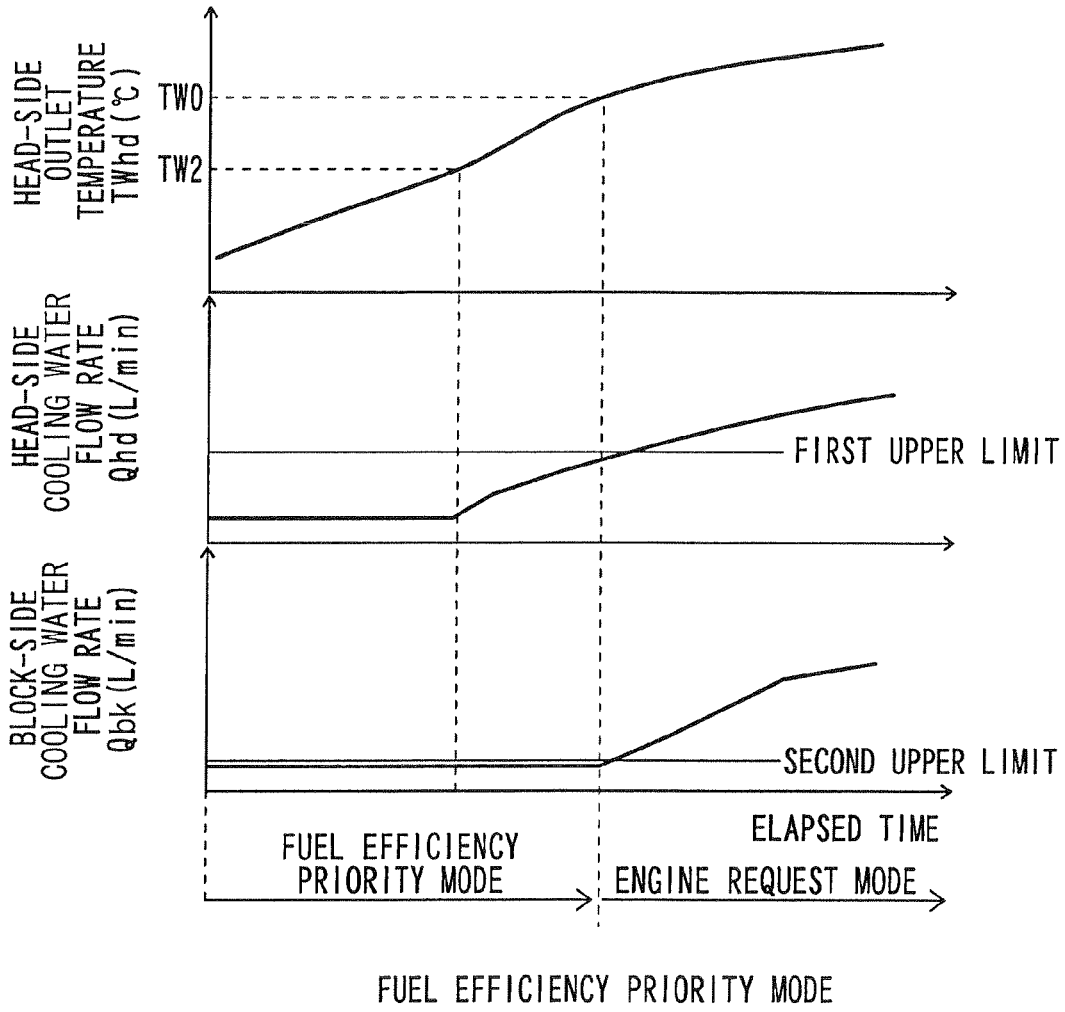
FIG. 4 is a time chart to show a change in a cooling water temperature at the time of the fuel efficiency priority mode of the first embodiment.
Figure 5:
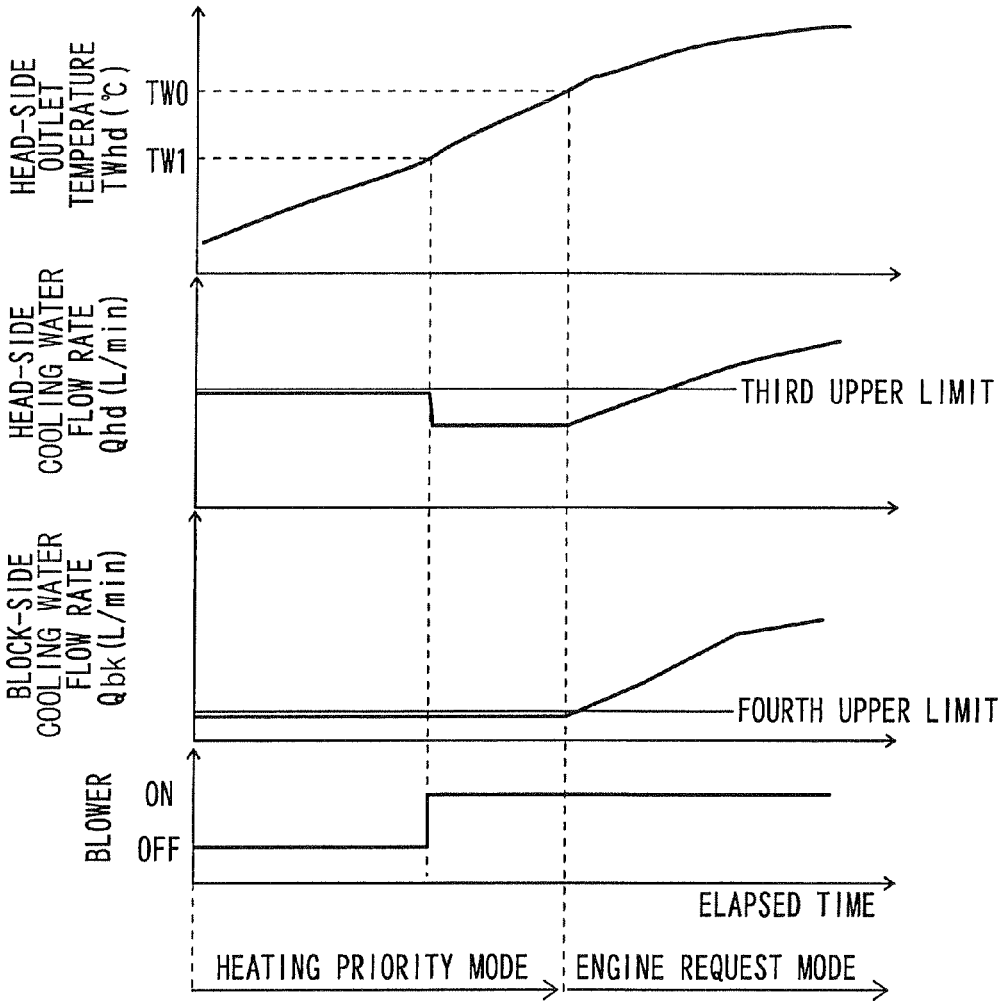
FIG. 5 is a time chart to show a change in the cooling water temperature at the time of the heating priority mode of the first embodiment.

Next, by the use of FIG. 3 to FIG. 5 in addition to FIG. 1 and FIG. 2, the operation of the internal combustion engine cooling system 1 of the present embodiment will be described.

Here, when the temperature of the engine 10 itself is lowered, for example, as in the case of starting the engine 10, a friction loss is increased by an increase in the viscosity of an engine oil to thereby impair the fuel efficiency of the vehicle. Further, a malfunction in the operation of a catalyst for cleaning the exhaust gas is caused by a decrease in the temperature of the exhaust gas. Thus, when the engine 10 is warmed up, it is desired to raise the temperature of the engine 10 itself quickly.

Therefore, in the internal combustion engine cooling system 1 of the present embodiment, the head-side outlet temperature TWhd is adopted as the temperature of the engine 10 itself, and when this head-side outlet temperature TWhd is lower than a base warming-up completion temperature TWO (in this embodiment, 65° C.), the internal combustion engine cooling system 1 is operated_in the fuel efficiency priority mode in which the temperature of the engine 10 itself is quickly raised.

Furthermore, because this internal combustion engine cooling system 1 utilizes the cooling water as the heat source for heating the vehicle compartment, even if the internal combustion engine cooling system 1 is operated in the fuel efficiency priority mode, when the occupant makes a heating request, the internal combustion engine cooling system 1 is required to realize a quick heating operation for quickly raising the temperature of the vehicle compartment. Thus, even if the internal combustion engine cooling system 1 is operated in the fuel efficiency priority mode, when the occupant turns on a heating switch to make a heating request, the internal combustion engine cooling system 1 is operated in the heating priority mode in which the temperature of the cooling water is quickly raised to a temperature to realize the heating of the vehicle compartment to thereby realize the quick heating.

On the other hand, when the temperature of the engine 10 itself is excessively raised, the engine 10 may be possibly overheated and consumes the fuel that is used for cooling an exhaust gas cleaning catalyst so as to prevent the catalyst from being melted by an excessive temperature rise and that does not contribute to an engine output, so that the fuel efficiency of the vehicle is impaired. Thus, after the warming-up of the engine 10 is finished, according to the operating condition of the engine 10, the internal combustion engine cooling system 1 is operated in an engine request mode in which the temperature of the engine 10 itself is kept within a predetermined temperature range (in this embodiment, the head-side outlet temperature TWhd is 65° C. or more and 75° C. or less).

Figure 3:
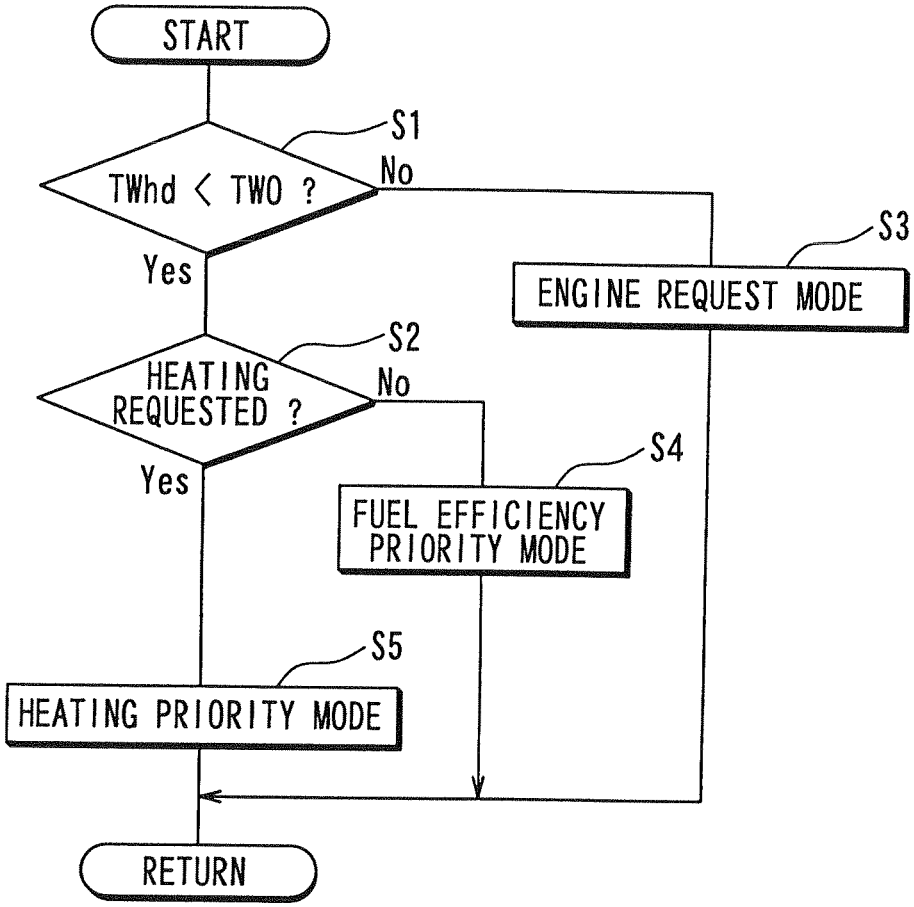
FIG. 3 is a flow chart to show a control processing of an engine control device of the first embodiment.

Specifically, the respective operation modes are switched as shown in a flow chart in FIG. 3. Here, FIG. 3 is a flow chart to show a control flow of the internal combustion engine cooling system 1 and the control flow shown in FIG. 3 is stored in a memory circuit (ROM) of the engine control device 50 and is executed as a subroutine of the control flow of performing the operation control of the engine 10.

First, at step S1, it is determined whether or not the detection value (specifically, head-side outlet temperature TWhd) of the cooling water temperature read at a predetermined control period is lower than the predetermined base warming-up completion temperature TWO. If it is determined at step S1 that the head-side outlet temperature TWhd is lower than the predetermined base warming-up completion temperature TWO, it is assumed that the warming-up of the engine 10 is not completed and the routine proceeds to step S2.

On the other hand, if it is determined at step S1 that the head-side outlet temperature TWhd is not lower than the predetermined base warming-up completion temperature TWO (that is, the head-side outlet temperature TWhd is equal to or more than the predetermined base warming-up completion temperature TWO), it is assumed that the warming-up of the engine 10 is completed and the routine proceeds to step S3 in which the internal combustion engine cooling system 1 is brought into an operating condition in the engine request mode and then the routine returns to a main routine.

The engine request mode at step S3 is an operation mode at the time of an ordinary operation after the completion of the warming-up. In this mode, the engine control device 50 controls the operations of the water pump 21 and the flow regulating valve 23 in such a way that the temperature of the cooling water is kept within the predetermined temperature range according to the operating condition of the engine 10.

Specifically, the operation of the water pump 21 is controlled by a feedback control technique or the like in such a way that the head-side outlet temperature TWhd is brought close to a base head-side outlet temperature KTWhd (in this embodiment, 70° C.). Further, the operation of the flow regulating valve 23 is controlled by the feedback control technique or the like in such a way that the block-side outlet temperature TWbk is brought close to a base block-side outlet temperature KTWbk (in this embodiment, 90° C.).

Moreover, the thermostat 26 regulates the flow rate of the cooling water flowing into the radiator 24 and the bypass passage 25 according to the temperature of the cooling water circulating in the thermostat 26, so that the temperature of the cooling water, which flows out of the thermostat 26 and is pressure-fed to the engine 10, is brought close to a predetermined inflow-side base temperature Twin. In this way, the temperature of the engine 10 itself is kept within a predetermined temperature range.

In this regard, describing a specific temperature in the engine request mode of this embodiment, as described above, the head-side outlet temperature TWhd is made lower than the block-side outlet temperature TWbk. This is because by lowering the head-side outlet temperature TWhd, the temperature of a combustion chamber can be lowered and hence anti-knocking performance can be improved.

Further, this is because by making the block-side outlet temperature TWbk higher than the head-side outlet temperature TWhd, the temperature of a portion (liner portion) of the cylinder in the cylinder block 11 that slides on the piston can be made higher to thereby decrease the viscosity of the engine oil for lubrication, which can inhibit the friction loss of the engine 10 and hence can improve the fuel efficiency of the vehicle.

Still further, in the engine request mode, the temperature of the cooling water circulating through the thermostat 26 is made higher than the base warming-up completion temperature TWO, so that the opening of the heater core side cooling water passage of the thermostat 26 is increased to a degree capable of supplying the heater core 31 with an amount of cooling water sufficient to heat the vehicle compartment. Thus, at the time of the engine request mode, when a heating request is made, the heating of the vehicle compartment can be quickly performed.

Next, it is determined at step S2 whether or not the heating switch is turned on. If it is determined at step S2 that that heating switch is turned on, it is assumed that a heating request is made by the occupant and the routine proceeds to step S5 in which the internal combustion engine cooling system is brought into the operating condition in the heating priority mode and then returns to the main routine.

On the other hand, if it is determined at step S2 that the heating switch is not turned on, it is assumed that the heating request is not made by the occupant and the routine proceeds to step S4 in which the internal combustion engine cooling system is brought into the operating condition in the fuel efficiency priority mode and then returns to the main routine. In the fuel efficiency priority mode of step S4, the engine control device 50 controls the operations of the water pump 21 and the flow regulating valve 23 in such a way as to quickly raise the temperature of the engine 10 itself.

Specifically, the operation of the water pump 21 is controlled in such a way that the flow rate of the cooling water flowing into the engine 10 is made less than in the engine request mode. Further, the operation of the flow regulating valve 23 is controlled in such a way that a head-side cooling water flow rate Qhd is equal to or less than a predetermined first upper limit (in this embodiment, 6 L/min) and that a block-side cooling water flow rate Qbk is equal to or less than a predetermined second upper limit (in this embodiment, 2 L/min).

These first and second upper limits are set to smaller flow rates with respect to the head-side cooling water flow rate Qhd and the block-side cooling water flow rate Qbk at the time of the ordinary operation (engine request mode), respectively. Further, in the fuel efficiency priority mode, the heating request is not made and hence the operation of the flow regulating valve 23 is controlled in such a way that the total flow rate of the cooling water flowing out of the block-side passage 11*a* is made to flow out to the joining part 22.

Still further, in the fuel efficiency priority mode, the head-side outlet temperature TWhd is lower than the base warming-up completion temperature TWO, so that in the thermostat 26, the radiator side cooling water passage is almost fully closed and the bypass side cooling water passage is almost fully opened. Hence, the cooling water flowing out of the engine 10 flows mainly into the bypass passage 25.

In this regard, even if the head-side outlet temperature TWhd is lower than the base warming-up completion temperature TWO, the heater core side cooling water passage of the thermostat 26 is not completely closed, so that a portion of the cooling water flowing out of the head-side passage 12*a* of the engine 10 flows into the heater core 31 through a head-side bypass passage 27. However, in the state where the heating request is not made, the blower 35 is stopped and hence the cooling water hardly radiates heat in the heater core 31.

Thus, in the fuel efficiency priority mode, the cooling water flows as shown by solid arrows in FIG. 1. Furthermore, in the fuel efficiency priority mode, as shown in FIG. 4, as the head-side outlet temperature TWhd is raised, the head-side cooling water flow rate Qhd is increased within a range lower than the first upper limit. Here, FIG. 4 is a time chart to show a change in the head-side cooling water flow rate Qhd, a change in the block-side cooling water flow rate Qbk, and a change in the head-side outlet temperature TWhd in the fuel efficiency priority mode.

Specifically, when the head-side outlet temperature TWhd is equal to or less than a predetermined base warming-up transition temperature TW2, the head-side cooling water flow rate Qhd is set to 2 L/min, and as the head-side outlet temperature TWhd becomes higher than the base warming-up transition temperature TW2, the head-side cooling water flow rate Qhd is increased within a range equal to or less than 6 L/min.

Thus, when the head-side outlet temperature TWhd is made higher than the base warming-up transition temperature TW2, the head-side outlet temperature TWhd is made lower than the block-side outlet temperature TWbk. In this regard, as to the base warming-up transition temperature TW2, a minimum value (in this embodiment, 40° C.) of the cooling water temperature can be adopted that does not have a bad effect on the quick warming-up of the engine 10 even if the quantity of waste heat made to flow out to the outside from the engine 10 is increased.

Moreover, in the heating priority mode at step S5, the engine control device 50 controls the operations of the water pump 21 and the flow regulating valve 23 in such a way that the quick heating of the vehicle compartment is realized.

Specifically, the operation of the water pump 21 is controlled in such a way that the flow rate of the cooling water flowing into the engine 10 becomes smaller in the heating priority mode than in the engine request mode. Further, the operation of the flow regulating valve 23 is controlled in such a way that the head-side cooling water flow rate Qhd is equal to or less than a predetermined third upper limit (in this embodiment, 10 L/min) and that the block-side cooling water flow rate Qbk is equal to or less than a predetermined fourth upper limit (in this embodiment, 2 L/min).

These third and fourth upper limits are set to flow rates smaller than the head-side cooling water flow rate Qhd and the block-side cooling water flow rate Qbk at the time of an ordinary operation (engine request mode), respectively. Moreover, in the heating priority mode, the heating request is made and hence the operation of the flow regulating valve 23 is controlled in such a way that the total flow rate of the cooling water flowing out of the block-side passage 11*a* is made to flow to the heater core 31.

Further, in the heating priority mode, as in the case of the fuel efficiency priority mode, the head-side outlet temperature TWhd becomes lower than the base warming-up completion temperature TWO, so that a radiator-side cooling water passage of the thermostat 26 is almost fully closed and a bypass-passage side cooling water passage is almost fully opened. Thus, the cooling water flowing out of the engine 10 flows mainly into the bypass passage 25.

In this regard, also in the heating priority mode, as in the case of the fuel efficiency priority mode, the opening of a heater-core side cooling water passage of the thermostat 26 becomes small, but the flow regulating valve 23 makes the total flow rate of the cooling water flowing out of the block-side passage 11*a* flow to the heater core 31, so that the flow rate of the cooling water circulating through the heater core 31 becomes more than in the fuel efficiency priority mode.

Thus, in the heating priority mode, the cooling water flows in the manner shown by the solid arrows in FIG. 2. Further, in the heating priority mode, as shown in FIG. 5, as the temperature of the head-side outlet temperature TWhd becomes higher, the head-side cooling water flow rate Qhd is decreased within a range that is less than the third upper limit and in which the heat quantity held by the cooling water flowing into the heater core 31 becomes a heat quantity sufficient as a heat source for heating. Here, FIG. 5 is a time chart to show a change in the head-side cooling water flow rate Qhd, a change in the block-side cooling water flow rate Qbk, and a change in the head-side outlet temperature TWhd.

Specifically, when the head-side outlet temperature TWhd is equal to or less than a predetermined heating start temperature TW1, the head-side cooling water flow rate Qhd is set to 10 L/min, and as the head-side outlet temperature TWhd becomes higher than the predetermined heating start temperature TW1, the head-side cooling water flow rate Qhd is decreased to a level of 6 L/min.

Thus, in the heating priority mode, the head-side cooling water flow rate Qhd becomes more than the block-side cooling water flow rate Qbk and the head-side outlet temperature TWhd becomes less than the block-side outlet temperature TWbk. In this regard, the heating start temperature TW1 is a temperature at which the blower 35 is activated to exchange heat between the cooling water and the blowing air in the heater core 31 to thereby start heating the blowing air, and a minimum value (in this embodiment, 40° C.) of the cooling water temperature that can realize the heating of the vehicle compartment can be adopted as the heating start temperature TW1.

The internal combustion engine cooling system 1 of the present embodiment is operated in the manner described above, so that at the time of the engine request mode, not only the temperature of the engine 10 itself can be kept within the predetermined temperature range but also the following excellent effects can be produced.

First, in the fuel efficiency priority mode and in the heating priority mode, the head-side cooling water flow rate Qhd and the block-side cooling water flow rate Qbk are made less than in the engine request mode, so that the quantity of the waste heat flowing out to the outside from the engine 10 can be decreased. Thus, the engine 10 can be warmed up more quickly than in the case where the engine 10 is warmed up in the engine request mode.

At this time, both in the fuel efficiency priority mode and in the heating priority mode, the block-side cooling water flow rate Qbk is made less than the head-side cooling water flow rate Qhd, so that the warming-up of the portion (liner portion) of the cylinder in the cylinder block 11 that slides on the piston can be efficiently accelerated. Thus, the friction loss of the engine 10 can be effectively inhibited to improve the fuel efficiency of the vehicle.

Further, in the fuel efficiency priority mode, the cooling water flowing out of the engine 10 is made to flow mainly into the bypass passage 25, so that the waste heat flowing out to the outside of the engine 10 can be effectively used to raise the temperature of all the cooling water in the cooling water circuit from the cooling water outlet (specifically, block-side and head-side outflow ports 10*b*, 10*c*) of the engine 10 to the cooling water inlet (specifically, inflow port 10*a*) thereof.

Still further, in the fuel efficiency priority mode, when the head-side outlet temperature TWhd becomes more than the base warming-up transition temperature TW2, the head-side cooling water flow rate Qhd is increased. Thus, without making a bad effect on the quick warming-up of the engine 10, the temperature of all the cooling water in the cooling water circuit can be efficiently raised by the heat held by the cooling water flowing out of the head-side passage 12*a* that is brought to a higher temperature than the temperature of the cooling water flowing out of the block-side passage 11*a*.

As a result, in the fuel efficiency priority mode, an improvement in the fuel efficiency of the vehicle and the quick warming-up of the engine 10 can be realized.

On the other hand, in the heating priority mode, the head-side cooling water flow rate Qhd is increased more than in the fuel efficiency priority mode, so that the waste heat flowing out to the outside of the engine 10 is increased and a warming-up time is made longer than in the fuel efficiency priority mode. However, the cooling water flowing out of the head-side passage 12*a* is guided to the heater core 31, so that this waste heat can be effectively used so as to raise the temperature of the cooling water flowing into the heater core 31.

Further, in the heating priority mode, the head-side cooling water flow rate Qhd is decreased as the temperature of the head-side outlet temperature TWhd is increased. Thus, after the temperature of the cooling water flowing into the heater core 31 is increased quickly to a temperature at which the heating of the vehicle compartment can be realized, as in the case of the fuel efficiency priority mode, the quick warming-up of the engine 10 can be realized.

As a result, in the heating priority mode, in addition to the improvement in the fuel efficiency of the vehicle, the quick warming-up of the engine 10 and the quick heating of the vehicle compartment can be realized at the same time.

Further, in the fuel efficiency priority mode and in the heating priority mode, as in the case of the engine request mode, the head-side outlet temperature TWhd becomes less than the block-side outlet temperature TWbk, so that the anti-knocking performance of the engine 10 can be improved and the fuel efficiency of the vehicle can be improved.

Still further, when a heating request is made while the internal combustion engine cooling system 1 of the present embodiment is operated in the fuel efficiency priority mode, by switching the internal combustion engine cooling system 1 from the fuel efficiency priority mode to heating priority mode, the realization of the quick warming-up of the engine 10 and the realization of the quick heating of the vehicle compartment when the heating request is made at the time of warming-up the engine 10 can be achieved further effectively at the same time.

Figure 6:
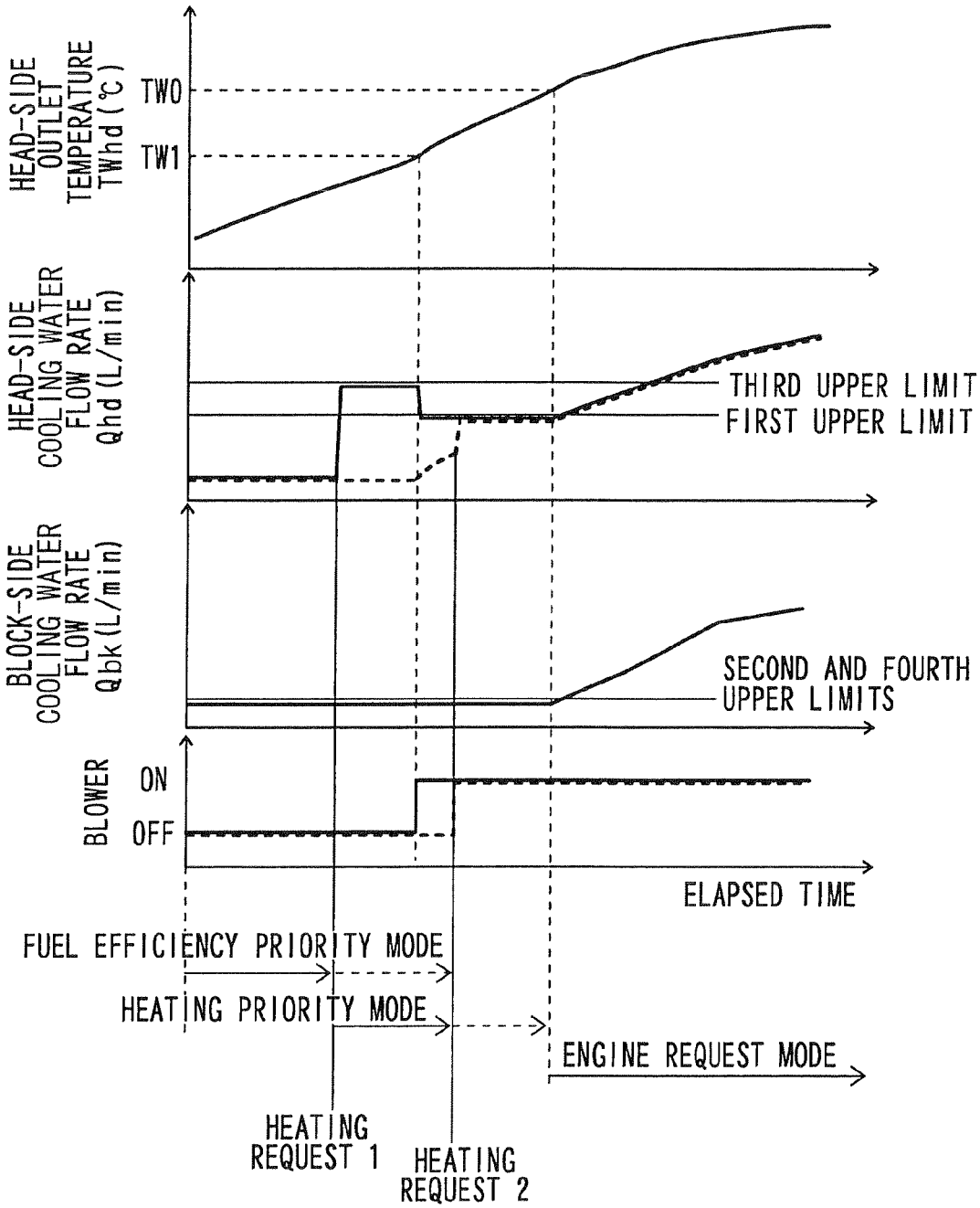
FIG. 6 is a time chart to show a change in the cooling water temperature in the case where the fuel efficiency priority mode of the first embodiment is shifted to the heating priority mode.

This will be described by the use of a time chart shown in FIG. 6. Here, FIG. 6 is a time chart to show a change in the head-side cooling water flow rate Qhd, a change in the block-side cooling water flow rate Qbk, and a change in the head-side outlet temperature TWhd in the case where the fuel efficiency priority mode is shifted to the heating priority mode. Moreover, in FIG. 6, the changes in the case where a heating request 1 is made when the head-side outlet temperature TWhd is equal to or less than the heating start temperature TW1 are shown by solid lines, whereas the changes in the case where a heating request 2 is made when the head-side outlet temperature TWhd is higher than the heating start temperature TW1 are shown by broken lines.

As is clear from the solid lines in FIG. 6, in the case where the heating request is made when the head-side outlet temperature TWhd is equal to or less than the heating start temperature TW1, the heating can be started only by increasing the temperature of the cooling water, which has its temperature already increased quickly in the fuel efficiency priority mode, to a value higher than the heating start temperature TW1. Further, as is clear from the broken lines in FIG. 6, in the case where the heating request is made when the head-side outlet temperature TWhd is higher than the heating start temperature TW1, the blower 35 can be operated immediately, so that the heating can be started at the same time when the heating request is made.

Second Embodiment

Figure 7:
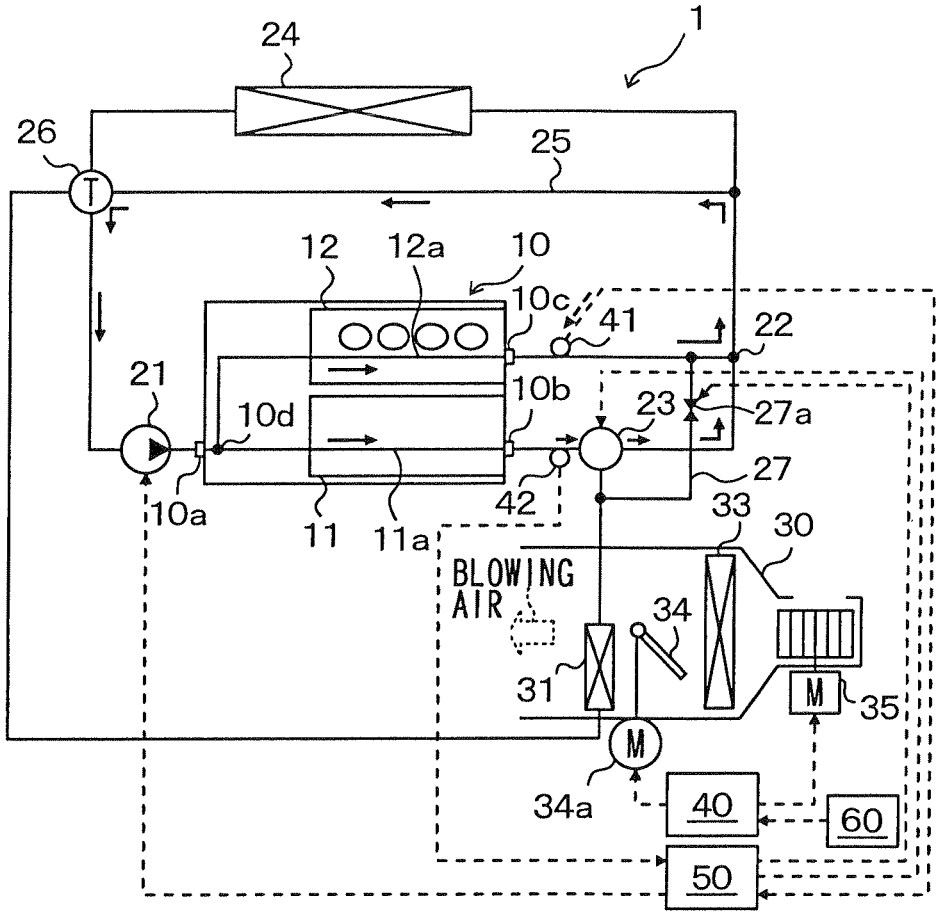
FIG. 7 is a general construction view of an internal combustion engine cooling system of a second embodiment.

In this embodiment, as shown by the general construction view in FIG. 7, an opening/closing valve 27*a* as an opening/closing means for opening and closing the head-side bypass passage 27 is added to the first embodiment. Here, in FIG. 7, the flow of the cooling water in the fuel efficiency priority mode of this embodiment is shown by solid arrows. Moreover, in FIG. 7, parts identical or equivalent to the parts in the first embodiment are denoted by the same reference characters. This is the same also in the following drawings.

The opening/closing valve 27*a* of this embodiment is constructed of an electromagnetic valve having its operation controlled by a control signal outputted from the engine control device 50. Specifically, the opening/closing valve 27*a* is controlled in such a way as to be opened in the engine request mode and in the heating priority mode and to be closed in the fuel efficiency priority mode. In this way, in the fuel efficiency priority mode, as shown in FIG. 7, the total flow rate of the cooling water flowing out of the head-side passage 12*a* can be made not to flow to the heater core 31 but to flow to the joining part 22 (bypass passage 25).

The other constructions and operations are the same as those in the first embodiment. Thus, according to the internal combustion engine cooling system 1 of this embodiment, it is possible to produce not only the same effect as the first embodiment but also to prevent the cooling water from radiating heat in the heater core 31 and to efficiently increase the temperature of all the cooling water in the cooling water circuit at the time of the fuel efficiency priority mode.

In this regard, in the case where the opening/closing valve 27*a* is adopted like this embodiment, the function of regulating the opening of the heater core side cooling water passage (the function of regulating the flow rate) by the second valve body of the thermostat 26 may be eliminated.

Third Embodiment

Figure 8:
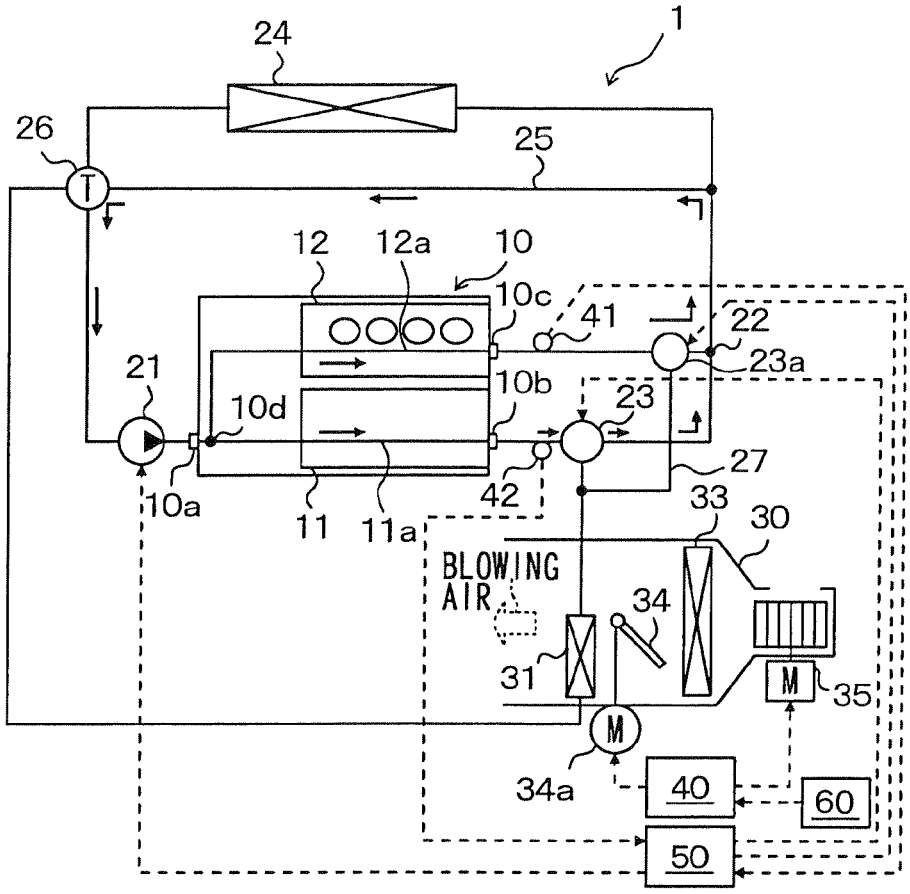
FIG. 8 is a general construction view of an internal combustion engine cooling system of a third embodiment.

This embodiment, as shown by a general construction view in FIG. 8, describes an example in which a head-side flow regulating valve 23*a* is arranged in the cooling water passage extending from the head-side outflow port 10*c* to the joining part 22 in the first embodiment. Here, in FIG. 8, the flow of the cooling water in the fuel efficiency priority mode of this embodiment will be shown by solid arrows. The basic construction of this head-side flow regulating valve 23*a* is the same as the flow regulating valve 23 of the first embodiment (in this embodiment, described by a block-side flow regulating valve 23).

Specifically, the head-side flow regulating valve 23*a* performs the function of regulating the flow rates of the cooling water flowing out to the joining part 22 (bypass passage 25) and the cooling water flowing out to the head-side bypass passage 27, of the cooling water flowing out of the head-side passage 12*a*.

Further, since the head-side flow regulating valve 23*a* regulates the passage cross-sectional area of the cooling water passage for connecting the head-side outflow port 10*c* to the joining part 22, the ratio of flow rate between the block-side cooling water flow rate Qbk circulating through the block-side passage 11*a* and the head-side cooling water flow rate Qhd circulating through the head-side passage 12*a* can be also changed. Thus, the flow regulating unit of this embodiment includes the head-side flow regulating valve 23*a* and the block-side flow regulating valve 23.

Moreover, as to the specific operation of the head-side flow regulating valve 23*a*, in the engine request mode, the head-side flow regulating valve 23*a* almost fully opens both of the cooling water passage for connecting the head-side outflow port 10*c* to the joining part 22 and the cooling water passage for connecting the head-side outflow port 10*c* to the head-side bypass passage 27. In this way, in the engine request mode, the cooling water flowing out of the head-side passage 12*a* can be made to flow out to both of the heater core 31 and the joining part 22.

In the fuel efficiency priority mode, the cooling water passage for connecting the head-side outflow port 10*c* to the joining part 22 is brought to a fully opened state and the cooling water passage for connecting the head-side outflow port 10*c* to the head-side bypass passage 27 is brought to a fully closed state. In this way, in the fuel efficiency priority mode, the total flow rate of the cooling water flowing out of the head-side passage 12*a* can be made not to flow out to the heater core 31 but to flow out to the joining part 22 (bypass passage 25).

In the heating priority mode, the cooling water passage for connecting the head-side outflow port 10*c* to the joining part 22 is fully closed and the cooling water passage for connecting the head-side outflow port 10*c* to the head-side bypass passage 27 is almost fully opened. In this way, in the heating priority mode, the total flow rate of the cooling water flowing out of the head-side passage 12*a* can be made not to flow out to the joining part 22 (bypass passage 25) but to flow into the heater core 31.

The other constructions and operations are the same as those in the first embodiment. Thus, the internal combustion engine cooling system 1 of the present embodiment not only can produce the same effect as the first embodiment but also can heat the blowing air efficiently by the heater core 31 in the heating priority mode and hence can further improve the heating performance.

In addition, in the fuel efficiency priority mode, it is possible to prevent the cooling water from radiating heat in the heater core 31 and hence to efficiently increase the temperature of all the cooling water in the cooling water circuit. In this regard, in the case where the head-side flow regulating valve 23*a* is adopted like this embodiment, the function of regulating the opening of the heater core side cooling water passage (regulating the flow rate) by the second valve body of the thermostat 26 may be eliminated.

Fourth Embodiment

In the present embodiment, an example will be described in which the first to the fourth upper limits described in the first embodiment are changed according to the operating condition of the engine 10. Here, the operating condition of the engine 10 will be described by the use of FIG. 15. Here, FIG. 15 is a performance characteristic graph to show the relationship between the rotating speed and the torque of a commonly-used engine.

In the commonly-used engine, an ignition timing of an air-fuel mixture of fuel injected into a combustion chamber and air for the fuel is regulated in such a way that a suitable torque can be outputted for the rotating speed of the engine. In contrast to this, when the torque outputted by the engine is increased, knocking cannot be prevented only by regulating the ignition timing because an increase in compression ratio is caused by an increase in temperature in the combustion chamber.

Moreover, in the commonly-used engine, when the temperature in the combustion chamber is excessively increased along with an increase in the rotating speed and the torque, the temperature of a catalyst for cleaning the exhaust gas is excessively increased to thereby melt or damage the catalyst, so that fuel for cooling the catalyst is injected to prevent the catalyst from being melted or damaged. The fuel for cooling the catalyst does not contribute to the output of the engine and hence impairs the fuel efficiency of the vehicle.

Figure 15:
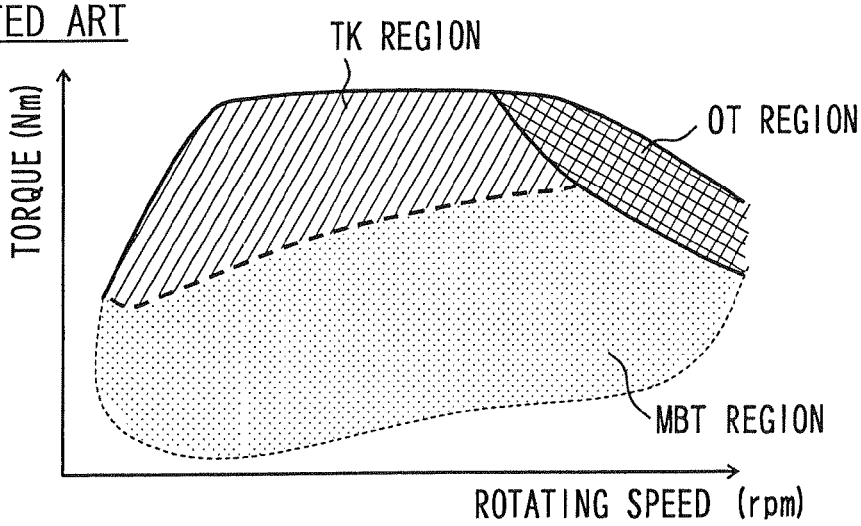
FIG. 15 RELATED ART
FIG. 15 is a performance characteristic graph of a commonly-used engine.

Here, in FIG. 15, a region to show the operating condition of the engine in which the engine can output a suitable torque is denoted by an MBT region (region shaded by dots), and a region to show the operating condition of the engine in which the engine causes knocking is denoted by a TK region (region shaded by slant lines), and a region to show the operating condition of the engine in which the fuel for cooling the catalyst is injected to prevent an excessive increase in the temperature of the catalyst is denoted by an OT region (region shaded by net).

In contrast to this, as to a means for inhibiting the knocking, it is only necessary to shift the operating condition of the engine from the TK region to the MBT region by increasing the head-side cooling water flow rate Qhd circulating through the head-side passage 12*a* on the cylinder head 12 side to cool the combustion chamber. Moreover, in order to inhibit the injection of the fuel for cooling the catalyst, it is only necessary to shift the operating condition from the OT region to the MBT region by increasing the head-side cooling water flow rate Qhd.

Thus, in the present embodiment, as shown by diagrams in FIG. 9 and FIG. 10, the first to fourth upper limits are changed according to the operating condition of the engine. Specifically, the first to fourth upper limits are changed on the basis of the rotating speed and the toque of the engine with reference to a control map, which is stored previously in the engine control device 50 and shows the performance characteristics of the engine.

Here, FIG. 9 shows the first and second upper limits of the respective operating regions in the fuel efficiency priority mode. Further, in FIG. 9, "VS" denotes 2 L/min, "S" denotes 2 to 10 L/min, "M" denotes 10 to 20 L/min, and "L" denotes 20 L/min or more.

Moreover, FIG. 10 shows the third and fourth upper limits of the respective operating regions in the heating priority mode. Further, for the third upper limit (head side) in FIG. 10, "S" denotes 6 to 10 L/min, "M" denotes 10 to 20 L/min, and "L" denotes 20 L/min or more. Still further, for the fourth upper limit (block side), "VS" denotes 2 L/min, "S" denotes 2 to 10 L/min, "M" denotes 10 to 20 L/min, and "L" denotes 20 L/min or more.

Thus, in this embodiment, in the case where the operating condition of the engine is the operating condition of the MBT region, the same effect as the first embodiment can be produced.

Further, as is clear from FIG. 9, at the time of the fuel efficiency priority mode, when the operating condition of the engine is brought to the operating condition of the OT region or the TK region, the first upper limit is increased and hence the operating condition of the OT region or the TK region can be shifted to the operating condition of the MBT region. In this way, it is possible to inhibit the fuel efficiency of the vehicle from being impaired and to improve the anti-knocking performance of the engine 10.

Still further, as is clear from FIG. 10, at the time of the heating priority mode, when the operating condition of the engine is brought to the operating condition of the OT region, the third upper limit is increased, which hence can inhibit the fuel efficiency of the vehicle from being impaired. In this regard, the changing of the first to fourth upper limits according to the operating condition of the engine 10, which has been described in this embodiment, may be applied to the internal combustion engine cooling system of the second and third embodiments.

Fifth Embodiment

Figure 11:
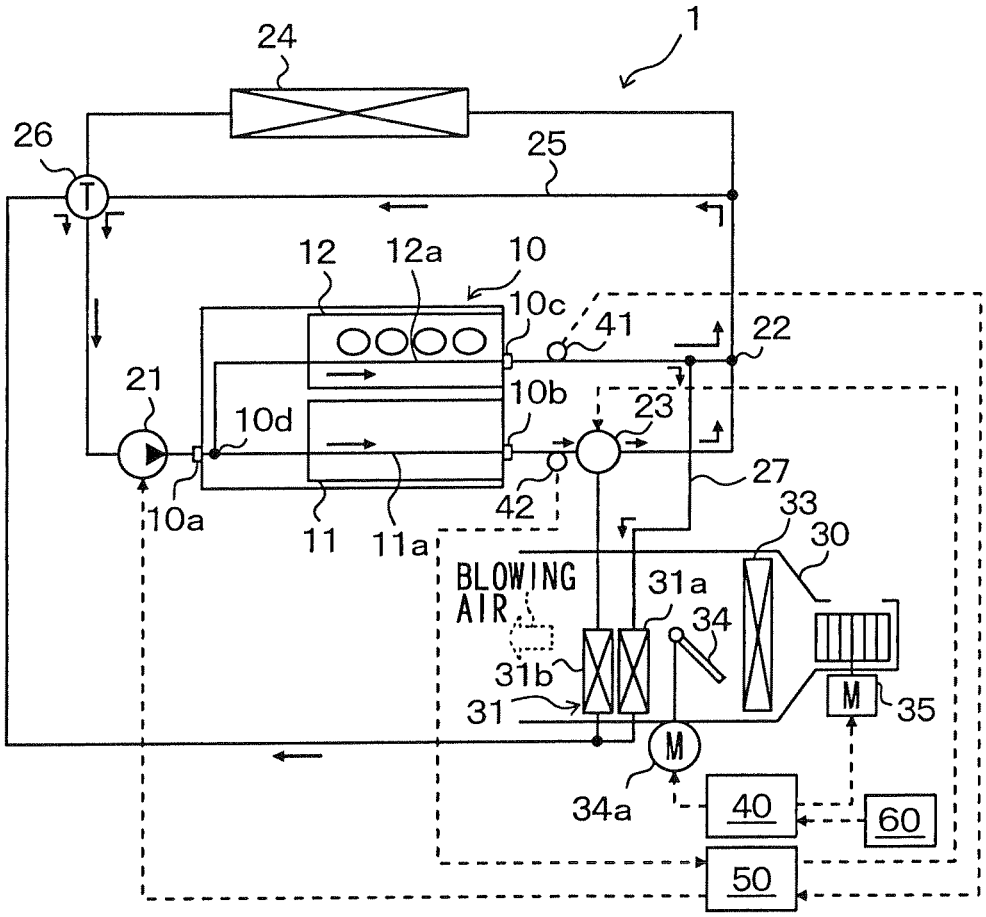
FIG. 11 is a general construction view to show a fuel efficiency priority mode of an internal combustion engine cooling system of a fifth embodiment.
Figure 12:
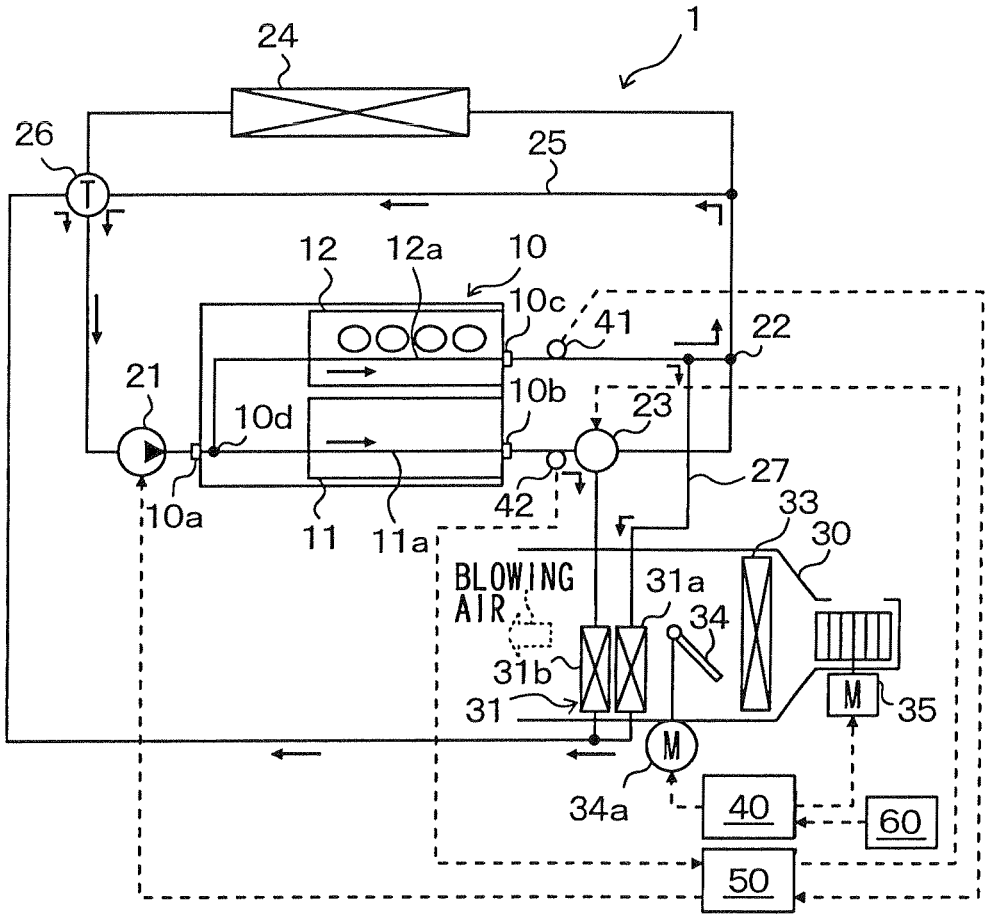
FIG. 12 is a general construction view to show a heating priority mode of the internal combustion engine cooling system of the fifth embodiment.

In the present embodiment, an example will be described in which two heat exchanging parts of a first heat exchanging part 31*a* and a second heat exchanging part 31*b* are employed as the heater core 31 as compared with the first embodiment, as shown by the general construction view in FIG. 11 and FIG. 12. Here, FIG. 11 shows the flow of the cooling water in the fuel efficiency priority mode of this embodiment by solid arrows, and FIG. 12 shows the flow of the cooling water in the heating priority mode of this embodiment by solid arrows.

The first heat exchanging part 31*a* is arranged in the head-side bypass passage 27 and performs the function of exchanging heat between a portion of the cooling water flowing out of the head-side passage 12*a* and the blowing air blown from the blower 35 to heat the blowing air. On the other hand, the second heat exchanging part 31*b* performs the function of exchanging heat between the cooling water flowing out of the flow regulating valve 23 and the blowing air after passing through the first heat exchanging part 31*a* to further heat the blowing air. Thus, the first heat exchanging part 31*a* is arranged on the upstream side of the flow of the blowing air with respect to the second heat exchanging part 31*b*.

Further, the head-side bypass passage 27 of this embodiment is connected in such a way that the flow of the cooling water flowing out of the head-side passage 12*a* is branched and is guided to the cooling water outlet side of the second heat exchanging part 31*b*. In this way, in this embodiment, it is possible to make the cooling water flowing out of the first heat exchanging part 31*a* join the cooling water flowing out of the second heat exchanging part 31*b* and to make the cooling water flow to the thermostat 26.

The other constructions and operations are the same as those in the first embodiment. Thus, the internal combustion engine cooling system 1 of this embodiment can produce the same effect as the first embodiment and can effectively utilize the waste heat of the engine 10 to heat the blowing air at the time of heating in the heating priority mode and in an ordinary operation (engine request mode).

In other words, in this embodiment, of the cooling water flowing out of the head-side passage 12*a* and the cooling water flowing out of the block-side passage 11*a*, the cooling water flowing out of the head-side passage 12*a* having a low temperature is made to flow into the first heat exchanging part 31*a* arranged on the upstream side of the blowing air and the cooling water flowing out of the block-side passage 11*a* having a high temperature is made to flow into the second heat exchanging part 31*b* arranged on the downstream side of the blowing air.

In this way, in both of the heat exchanging parts 31*a*, 31*b*, a temperature difference between the cooling water and the blowing air, which are circulated through them, can be secured, so that heat can be effectively exchanged between the cooling water and the blowing air. As a result, at the time of heating the vehicle compartment, the waste heat of the engine 10 can be effectively utilized.

In this regard, this effective utilization of the waste heat of the engine 10 is extremely effective for heating the vehicle compartment in the hybrid vehicle in which the temperature of the cooling water is hard to rise because the engine 10 is stopped when the vehicle runs. Moreover, the first to fourth upper limits may be changed for the internal combustion engine cooling system 1 of this embodiment according to the operating condition of the engine 10, as described in the fourth embodiment.

Sixth Embodiment

Figure 13:
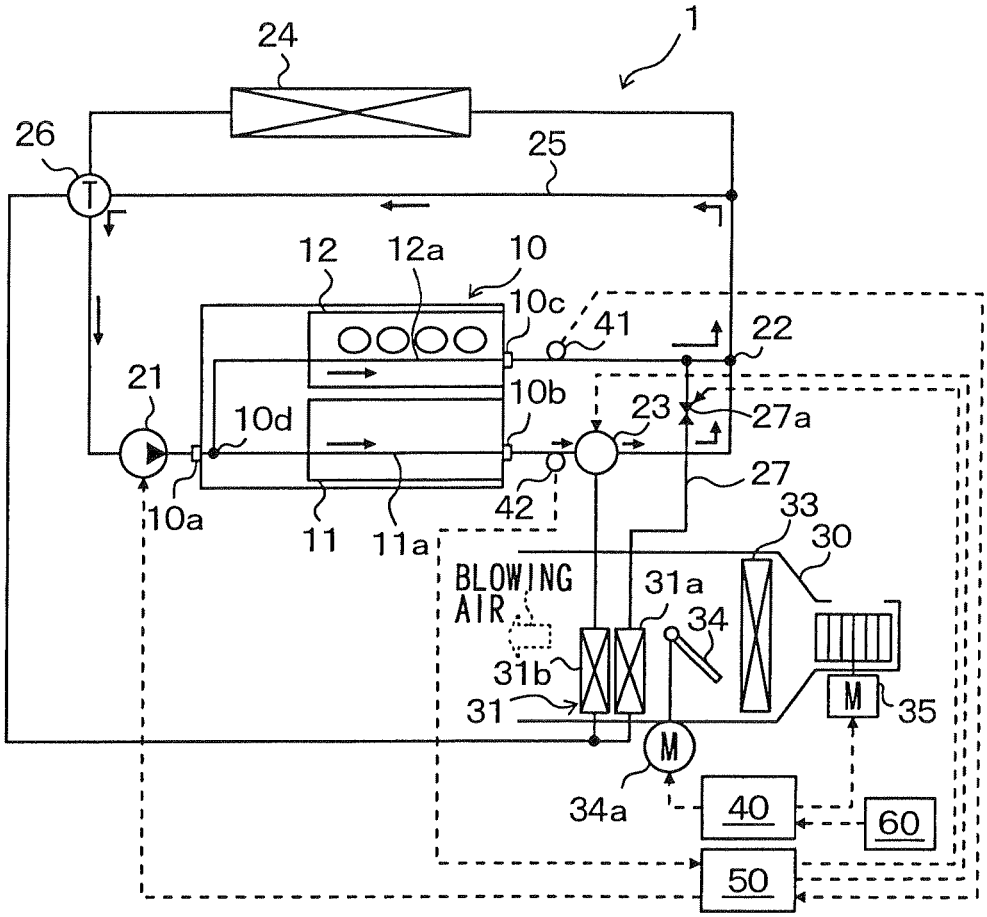
FIG. 13 is a general construction view of an internal combustion engine cooling system of a sixth embodiment.

The present embodiment is an example in which the same opening/closing valve 27*a* as the second embodiment is additionally arranged on the upstream side of the first heat exchanging part 31*a* of the head-side bypass passage 27 in the fifth embodiment, as shown by the general construction view in FIG. 13. The other constructions and the operations are the same as those in the fifth embodiment.

Thus, according to the internal combustion engine cooling system 1 of this embodiment, it is possible not only to produce the same effect as the fifth embodiment but also, as in the case of the second embodiment, to prevent the cooling water from radiating heat in the heater core 31 and hence to efficiently increase the temperature of all the cooling water in the cooling water circuit at the time of the fuel efficiency priority mode.

In this regard, also in this embodiment, as in the case of the second embodiment, the function of regulating the opening (regulating flow rate) of the heater core side cooling water passage by the second valve body of the thermostat 26 may be eliminated. Moreover, the first to fourth upper limits may be changed for the internal combustion engine cooling system 1 of this embodiment according to the operating condition of the engine 10, as described in the fourth embodiment.

Seventh Embodiment

Figure 14:
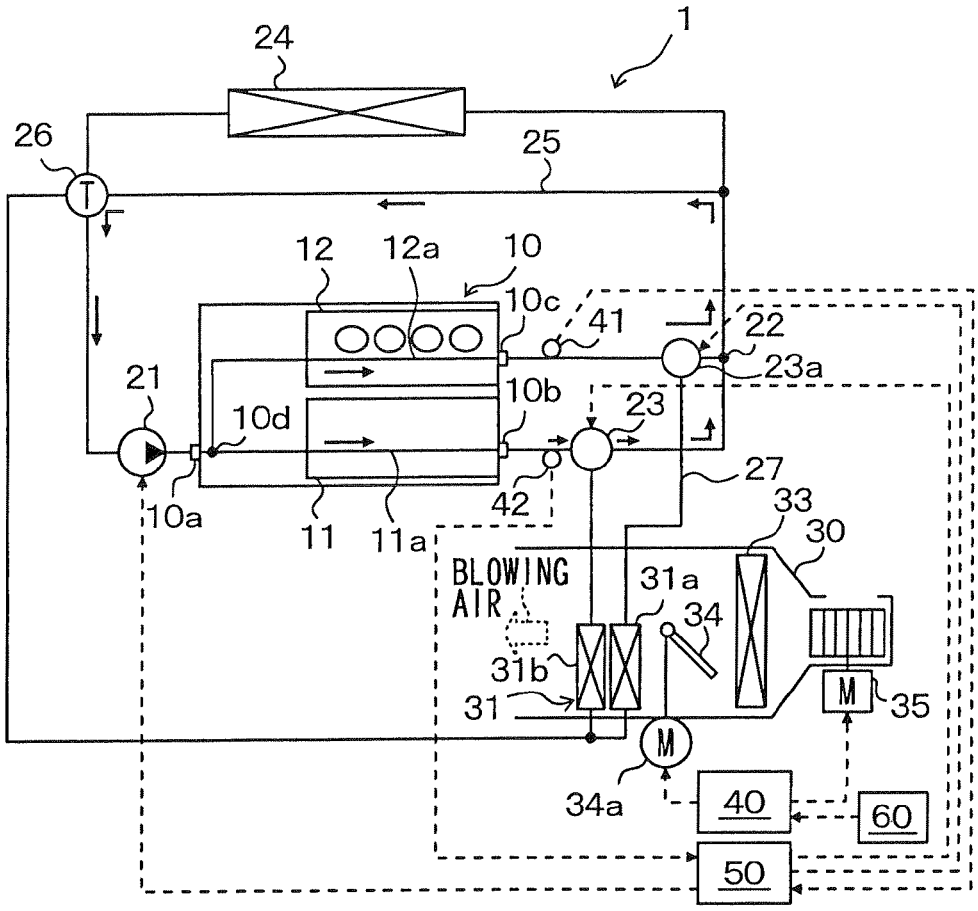
FIG. 14 is a general construction view of an internal combustion engine cooling system of a seventh embodiment.

The present embodiment is an example in which the same head-side flow regulating valve 23*a* as the third embodiment is arranged in the cooling water passage extending from the head-side outflow port 10*c* to the joining part 22 in the fifth embodiment as shown by the general construction view in FIG. 14. The other constructions and the operations are the same as those in the fifth embodiment.

Thus, according to the internal combustion engine cooling system 1 of this embodiment, it is possible not only to produce the same effect as the fifth embodiment but also, as in the case of the third embodiment, to heat the blowing air effectively by the heater core 31 and hence to further improve the heating performance in the heating priority mode. Moreover, in the fuel efficiency priority mode, it is possible to prevent the cooling water from radiating heat in the heater core 31 and hence to efficiently increase the temperature of all the cooling water in the cooling water circuit.

In this regard, also in this embodiment, as in the case of the third embodiment, the function of regulating the opening (regulating flow rate) of the heater core side cooling water passage by the second valve body of the thermostat 26 may be eliminated. Moreover, the first to fourth upper limits may be changed for the internal combustion engine cooling system 1 of this embodiment according to the operating condition of the engine 10, as described in the fourth embodiment.

Other Embodiments

The present disclosure is not limited to the embodiments described above but various modifications can be made within the scope not departing from the gist of the present disclosure.

(1) In the embodiments described above, the embodiments have been described in which the head-side outlet temperature TWhd is employed as the temperature of the engine 10 itself, but the other temperature may be employed as the temperature of the engine 10 itself. For example, the block-side outlet temperature TWbk may be employed or the surface temperature of the engine 10 itself or, in the first to fourth embodiments, the temperature of the cooling water flowing into the heater core 31 can be employed.

Further, in the embodiments described above, the embodiments have been described in which the specific temperatures of the heating start temperature TW1 and the base warming-up transition temperature TW2 are equal to the same value (40° C.). However, the specific temperatures of the heating start temperature TW1 and the base warming-up transition temperature TW2 may be different values.

(2) In the embodiments described above, the embodiments have been described in which the thermostat 26 constructed in such a way as to regulate the cooling water flow rate according to the temperature of the cooling water circulating through the thermostat 26 is employed to thereby bring the temperature of the cooling water pressure-fed to the engine 10 close to the inflow-side base temperature Twin. However, it is possible to eliminate the thermostat 26 and to employ an electric actuator made of a linear solenoid valve, which can continuously change the cross-sectional area of the cooling water passage, or the like.

In this case, it is only necessary to employ a temperature detecting means for detecting the temperature of the cooling water pressure-fed to the engine 10 and to control the operation of the electric actuator by a feedback control technique or the like in such a way as to bring the detection value of this temperature detecting means close to the inflow-side base temperature Twin.

(3) In the embodiments described above, it is assumed that the heating request is made when the occupant turns on the heating switch, but the heating request is not limited to this. For example, when the vehicle start switch is turned on, if the outside air temperature is a predetermined base outside air temperature or less, it may be assumed that the heating request is made, or if the air temperature in the vehicle compartment is a predetermined base inside air temperature or less, it may be assumed that the heating request is made.

As to the base outside air temperature or the base inside air temperature, for example, a temperature of the order of 15° C. can be adopted as the temperature when the occupant wants the vehicle compartment to be heated. Further, both of the heating request based on the outside air temperature and the inside air temperature and the heating request made by the heating switch may be adopted.

To sum up, the cooling system 1 for the internal combustion engine 10 in accordance with the above embodiments may be described as follows.

A cooling system 1 is for cooling an internal combustion engine 10 by a flow of cooling water through the engine 10 such that temperature of the engine 10 in normal operation falls within a predetermined temperature range. At least a part of cooling water is used for a heat source for heating air blown toward an air-conditioning target space. The engine 10 includes a cylinder block 11, a block-side passage 11*a* through which cooling water for cooling the cylinder block 11 flows, a cylinder head 12, and a head-side passage 12*a* through which cooling water for cooling the cylinder head 12 flows. The cooling system 1 includes a cooling water pressure-feeding unit 21, a heating heat exchanger 31, 31*a*, 31*b*, a radiating heat exchanger 24, a bypass passage 25, and a flow regulating unit 23, 23*a*. The cooling water pressure-feeding unit 21 is configured to pressure-feed cooling water into the block-side passage 11*a* and the head-side passage 12*a*. The heating heat exchanger 31, 31*a*, 31*b* is configured to exchange heat between cooling water flowing out from at least one of the block-side passage 11*a* and the head-side passage 12*a*, and the blown air. The radiating heat exchanger 24 is configured to exchange heat between cooling water flowing out of the block-side passage 11*a* and the head-side passage 12*a*, and outside air, so that cooling water radiates heat. The bypass passage 25 guides cooling water flowing out of the block-side passage 11*a* and the head-side passage 12*a* to bypass the heating heat exchanger 31, 31*a*, 31*b* and the radiating heat exchanger 24 and to flow into a suction side of the cooling water pressure-feeding unit 21. The flow regulating unit 23, 23*a* is configured to regulate at least one of a block-side cooling water flow rate Qbk, which is a flow rate of cooling water flowing through the block-side passage 11*a*, and a head-side cooling water flow rate Qhd, which is a flow rate of cooling water flowing through the head-side passage 12*a*. At a time of warm-up of the engine 10, the flow regulating unit 23, 23*a* is configured to operate in a fuel efficiency priority mode. In the fuel efficiency priority mode, the flow regulating unit 23, 23*a* regulates the head-side cooling water flow rate Qhd to be equal to or smaller than a first upper limit, which is equal to or smaller than the head-side cooling water flow rate Qhd when the engine 10 is in the normal operation; the flow regulating unit 23, 23*a* regulates the block-side cooling water flow rate Qbk to be equal to or smaller than a second upper limit, which is equal to or smaller than the first upper limit; and the flow regulating unit 23, 23*a* regulates the flow of cooling water such that cooling water flowing out of the block-side passage 11*a* and the head-side passage 12*a* flows mainly into the bypass passage 25. When a heating request to heat the blown air by the heating heat exchanger 31, 31*a*, 31*b* is made at the time of warm-up of the engine 10, the flow regulating unit 23, 23*a* is configured to operate in a heating priority mode. In the heating priority mode, the flow regulating unit 23, 23*a* regulates the head-side cooling water flow rate Qhd to be equal to or smaller than a third upper limit, which is equal to or smaller than the head-side cooling water flow rate Qhd when the engine 10 is in the normal operation and higher than the first upper limit; the flow regulating unit 23, 23*a* regulates the block-side cooling water flow rate Qbk to be equal to or smaller than a fourth upper limit, which is equal to or smaller than the third upper limit; and the flow regulating unit 23, 23*a* regulates the flow of cooling water such that at least cooling water flowing out of the head-side passage 12*a* flows into the heating heat exchanger 31, 31*a*.

Accordingly, at the time of warming up the internal combustion engine 10, both in the fuel efficiency priority mode and in the heating priority mode, the total value of the head-side cooling water flow rate Qhd and the block-side cooling water flow rate Qbk (that is, the flow rate of the cooling water circulating through the internal combustion engine 10) can be decreased with respect to the total value at the time of an ordinary operation. Thus, at the time of warming up the internal combustion engine 10, the quantity of waste heat flowing out to the outside of the internal combustion engine 10 can be decreased with respect to the waste heat at the ordinary operation. As a result, the internal combustion engine 10 can be warmed up more quickly than at the time of the ordinary operation.

Further, the second upper limit is set at the value equal to or less than the first upper limit and the fourth upper limit is set at the value equal to or less than the third upper limit, so that in either of the modes, the block-side cooling water flow rate Qbk can be made less than the heat-side cooling water flow rate Qhd. This can efficiently accelerate the warming-up of a portion of the cylinder on the cylinder block 11 side that slides on the piston and hence can improve the fuel efficiency of the internal combustion engine 10.

Still further, in the fuel efficiency priority mode, the cooling water flowing out of the internal combustion engine 10 is made to flow mainly into the bypass passage 25, so that the waste heat flowing out to the outside of the internal combustion engine 10 is not radiated to the outside but can be effectively used for increasing the temperature of all the cooling water.

Thus, in the fuel efficiency priority mode, an improvement in the fuel efficiency of the internal combustion engine 10 and the quick warming-up of the internal combustion engine 10 can be realized.

On the other hand, in the heating priority mode, the third upper limit is set at the value higher than the first upper limit, so that the cooling water flowing out of the head-side passage 12*a* can be made to flow into the heating heat exchanger 31 in a state where the head-side cooling water flow rate Qhd is made larger than in the fuel efficiency priority mode. This can make it possible to effectively use the waste heat flowing out to the outside of the internal combustion engine 10 so as to increase the temperature of the cooling water flowing into the heating heat exchanger 31.

Thus, in the heating priority mode, in addition to an improvement in the fuel efficiency, both of the quick warming-up of the internal combustion engine 10 and the quick heating of the vehicle compartment can be realized.

Further, when the heating request is made in the fuel efficiency priority mode and hence the fuel efficiency priority mode is switched to the heating priority mode, both of the quick warming-up of the internal combustion engine 10 and the quick heating of the vehicle compartment when the heating request is made at the time of warming-up of the engine can be realized more effectively.

In this regard, "the head-side cooling water flow rate Qhd when the engine 10 is in the normal operation" means the head-side cooling water flow rate in the state where the operation of the engine 10 is stable at the time of the normal operation and hence does not mean the head-side cooling water flow rate in the period of transition in which the operation of the engine 10 is shifted to a stable state such as immediately after the fuel efficiency priority mode is shifted to the normal operation or immediately after the heating priority mode is shifted to the normal operation.

Moreover, the meaning of "cooling water flows mainly into the bypass passage 25" is not limited to the meaning that the total flow rate of the cooling water is made to flow into the bypass passage 25 but allows the meaning that a little portion of the cooling water is made to flow into the other cooling water passage because of the connection of piping or the like.

A temperature TWbk, TWhd of cooling water flowing out from one of the block-side passage 11*a* and the head-side passage 12*a* may be used for the temperature of the engine 10.

In the heating priority mode, the flow regulating unit 23, 23*a* may be configured to decrease the head-side cooling water flow rate Qhd in a range that is equal to or smaller than the third upper limit in accordance with an increase in a temperature TWbk, TWhd of cooling water flowing out from one of the block-side passage 11*a* and the head-side passage 12*a*.

Accordingly, as in the case of the fuel efficiency priority mode, the quick warming-up of the internal combustion engine 10 can be realized by decreasing the head-side cooling water flow rate Qhd after the temperature of the cooling water TWbk, TWhd is increased to a level at which the blowing air can be sufficiently heated.

In the heating priority mode, a head-side outlet temperature TWhd that is a temperature of cooling water flowing out of the head-side passage 12*a* may be lower than a block-side outlet temperature TWbk that is a temperature of cooling water flowing out of the block-side passage 11*a*.

Accordingly, the anti-knocking performance of the internal combustion engine 10 can be improved by decreasing the temperature of the cylinder head side, and the fuel efficiency of the internal combustion engine 10 can be further improved by increasing the temperature of the cylinder block side with respect to the temperature of the cylinder head side.

In the heating priority mode, when the engine 10 is brought into an operating condition where an amount of fuel injected into the engine 10 needs to be increased so as to cool a catalyst, which is connected to an exhaust passage of the engine 10 for purifying exhaust gas of the engine 10, the third upper limit may be increased.

Here, in the operating condition where the internal combustion engine 10 needs to cool the catalyst, the injected fuel is increased and hence the fuel efficiency of the internal combustion engine 10 is impaired. In contrast to this, since the third upper limit can be increased to increase the head-side cooling water flow rate Qhd, the operating condition of the internal combustion engine 10 can be shifted from the operating condition in which the catalyst needs to be cooled to the operating condition in which the catalyst does not need to be cooled.

As a result, it is possible to inhibit the fuel efficiency of the internal combustion engine 10 from being impaired. Here, the meaning of "the third upper limit is increased" includes the meaning that the third upper limit is made larger than the head-side cooling water flow rate Qhd at the time of the normal operation.

In the heating priority mode, the flow regulating unit 23, 23*a* may regulate the flow of cooling water such that cooling water flowing out of the block-side passage 11*a* and the head-side passage 12*a* flows into the heating heat exchanger 31 without flowing into the radiating heat exchanger 24.

Accordingly, at the time of the heating priority mode, it is possible to inhibit the cooling water from radiating heat to the outside air in the radiating heat exchanger 24 and hence to heat the blowing air efficiently in the heating heat exchanger 31, so that a heating performance can be further improved.

In the fuel efficiency priority mode, the flow regulating unit 23, 23*a* may be configured to increase the head-side cooling water flow rate Qhd within the first upper limit in accordance with an increase in a temperature TWbk, TWhd of cooling water flowing out from one of the block-side passage 11*a* and the head-side passage 12*a*.

Accordingly, the temperature of all the cooling water in the cooling water circuit can be efficiently increased by increasing the quantity of the waste heat made to flow out to the outside of the internal combustion engine 10 after the temperature TWbk, TWhd of the cooling water is increased to a level that does not have a bad effect on the quick warming-up of the internal combustion engine 10 even if the quantity of the waste heat made to flow out to the outside of the internal combustion engine 10 is increased.

In the fuel efficiency priority mode, a head-side outlet temperature TWhd that is a temperature of cooling water flowing out of the head-side passage 12*a* may be lower than a block-side outlet temperature TWbk that is a temperature of cooling water flowing out of the block-side passage 11*a*.

Accordingly, the anti-knocking performance of the internal combustion engine 10 can be improved by decreasing the temperature on the cylinder head side, and the fuel efficiency of the internal combustion engine 10 can be further improved by increasing the temperature on the cylinder block side with respect to the temperature on the cylinder head side.

In the fuel efficiency priority mode, when the engine 10 is brought into an operating condition where a catalyst, which is connected to an exhaust passage of the engine 10 for purifying exhaust gas of the engine 10, needs to be cooled or an operating condition where the engine 10 is likely to cause knocking, the first upper limit may be increased.

Accordingly, the head-side cooling water flow rate Qhd can be increased by increasing the first upper limit, so that the operating condition of the internal combustion engine 10 can be shifted from the operating condition in which the catalyst needs to be cooled to the operating condition in which the catalyst does not need to be cooled and the anti-knocking performance of the internal combustion engine 10 can be improved by decreasing the temperature of the combustion chamber.

As a result, it is possible to inhibit the fuel efficiency of the internal combustion engine 10 from being impaired and to realize a stable operation. In this regard, the meaning of "the first upper limit is increased" is a meaning including that the first upper limit is increased to a level larger than the head-side cooling water flow rate Qhd at the time of the normal operation.

In the fuel efficiency priority mode, the flow regulating unit 23, 23*a* may regulate the flow of cooling water such that cooling water flowing out of the block-side passage 11*a* and the head-side passage 12*a* flows into the bypass passage 25 without flowing into the heating heat exchanger 31, 31*a*, 31*b*.

Accordingly, it is possible to prevent the cooling water from radiating heat in the heating heat exchanger 31 at the time of the fuel efficiency priority mode and hence to complete the warming-up of the internal combustion engine 10 in an earlier stage.

The heating heat exchanger 31 may be configured to exchange heat between cooling water, which is a mixture of cooling water flowing out of the block-side passage 11*a* and cooling water flowing out of the head-side passage 12*a*, and the blown air. The heating heat exchanger 31, 31*a*, 31*b* may include: a first heat exchanging part 31*a* that is configured to exchange heat between the blown air and cooling water flowing out of the head-side passage 12*a*; and a second heat exchanging part 31*b* that is configured to exchange heat between the blown air passing through the first heat exchange part 31*a* and cooling water flowing out of the block-side passage 11*a*.

The flow regulating unit 23, 23*a* may include a first flow regulating valve 23 where cooling water flowing out of the block-side passage 11*a* is divided between cooling water flowing toward the bypass passage 25 and cooling water flowing toward the heating heat exchanger 31, 31*a*, 31*b*. The first flow regulating valve 23 may be configured to regulate a flow rate of cooling water flowing out toward the bypass passage 25 and a flow rate of cooling water flowing out toward the heating heat exchanger 31, 31*a*, 31*b*.

The flow regulating unit 23, 23*a* may include a second flow regulating valve 23*a* where cooling water flowing out of the head-side passage 12*a* is divided between cooling water flowing toward the bypass passage 25 and cooling water flowing toward the heating heat exchanger 31, 31*a*. The second flow regulating valve 23*a* may be configured to regulate a flow rate of cooling water flowing out toward the bypass passage 25 and a flow rate of cooling water flowing out toward the heating heat exchanger 31, 31*a*.

The cooling system 1 may further include a heating request input unit 60 configured to make a request to heat the blown air through operation thereof by a user of the cooling system 1. The heating request includes the request to heat the blown air through the operation of the heating request input unit 60.

The heating request may include an outside air temperature Tam being equal to or lower than a predetermined base outside air temperature. The heating request may include an inside air temperature in the air-conditioning target space being equal to or lower than a predetermined base inside air temperature. As to the base inside air temperature or the base outside air temperature, a temperature to which the user wants the air-conditioning target space to be heated can be adopted.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A cooling system for cooling an internal combustion engine by a flow of cooling water through the engine such that temperature of the engine in normal operation falls within a predetermined temperature range, wherein:

at least a part of cooling water is used for a heat source for heating air blown toward an air-conditioning target space; and the engine includes a cylinder block, a block-side passage through which cooling water for cooling the cylinder block flows, a cylinder head, and a head-side passage through which cooling water for cooling the cylinder head flows, the cooling system comprising:

a cooling water pressure-feeding unit configured to pressure-feed cooling water into the block-side passage and the head-side passage;

a heating heat exchanger configured to exchange heat between cooling water flowing out from at least one of the block-side passage and the head-side passage, and the blown air;

a radiating heat exchanger configured to exchange heat between cooling water flowing out of the block-side passage and the head-side passage, and outside air, so that cooling water radiates heat;

a bypass passage that guides cooling water flowing out of the block-side passage and the head-side passage to bypass the heating heat exchanger and the radiating heat exchanger and to flow into a suction side of the cooling water pressure-feeding unit; and a flow regulating unit configured to regulate at least one of a block-side cooling water flow rate, which is a flow rate of cooling water flowing through the block-side passage, and a head-side cooling water flow rate, which is a flow rate of cooling water flowing through the head-side passage, wherein:

at a time of warm-up of the engine, the flow regulating unit is configured to operate in a fuel efficiency priority mode in which:

the flow regulating unit regulates the head-side cooling water flow rate to be equal to or smaller than a first upper limit, which is equal to or smaller than the head-side cooling water flow rate when the engine is in the normal operation;

the flow regulating unit regulates the block-side cooling water flow rate to be equal to or smaller than a second upper limit, which is equal to or smaller than the first upper limit; and the flow regulating unit regulates the flow of cooling water such that cooling water flowing out of the block-side passage and the head-side passage flows mainly into the bypass passage; and when a heating request to heat the blown air by the heating heat exchanger is made at the time of warm-up of the engine, the flow regulating unit is configured to operate in a heating priority mode in which:

the flow regulating unit regulates the head-side cooling water flow rate to be equal to or smaller than a third upper limit, which is equal to or smaller than the head-side cooling water flow rate when the engine is in the normal operation and higher than the first upper limit;

the flow regulating unit regulates the block-side cooling water flow rate to be equal to or smaller than a fourth upper limit, which is equal to or smaller than the third upper limit; and the flow regulating unit regulates the flow of cooling water such that at least cooling water flowing out of the head-side passage flows into the heating heat exchanger.

2. The cooling system according to claim 1, wherein a temperature of cooling water flowing out from one of the block-side passage and the head-side passage is used for the temperature of the engine.

3. The cooling system according to claim 1, wherein in the heating priority mode, the flow regulating unit is configured to decrease the head-side cooling water flow rate in a range that is equal to or smaller than the third upper limit in accordance with an increase in a temperature of cooling water flowing out from one of the block-side passage and the head-side passage.

4. The cooling system according to claim 1, wherein in the heating priority mode, a head-side outlet temperature that is a temperature of cooling water flowing out of the head-side passage is lower than a block-side outlet temperature that is a temperature of cooling water flowing out of the block-side passage.

5. The cooling system according to claim 1, wherein in the heating priority mode, when the engine is brought into an operating condition where an amount of fuel injected into the engine needs to be increased so as to cool a catalyst, which is connected to an exhaust passage of the engine for purifying exhaust gas of the engine, the third upper limit is increased.

6. The cooling system according to claim 1, wherein in the heating priority mode, the flow regulating unit regulates the flow of cooling water such that cooling water flowing out of the block-side passage and the head-side passage flows into the heating heat exchanger without flowing into the radiating heat exchanger.

7. The cooling system according to claim 1, wherein in the fuel efficiency priority mode, the flow regulating unit is configured to increase the head-side cooling water flow rate within the first upper limit in accordance with an increase in a temperature of cooling water flowing out from one of the block-side passage and the head-side passage.

8. The cooling system according to claim 1, wherein in the fuel efficiency priority mode, a head-side outlet temperature that is a temperature of cooling water flowing out of the head-side passage is lower than a block-side outlet temperature that is a temperature of cooling water flowing out of the block-side passage.

9. The cooling system according to claim 1, wherein in the fuel efficiency priority mode, when the engine is brought into an operating condition where a catalyst, which is connected to an exhaust passage of the engine for purifying exhaust gas of the engine, needs to be cooled or an operating condition where the engine is likely to cause knocking, the first upper limit is increased.

10. The cooling system according to claim 1, wherein in the fuel efficiency priority mode, the flow regulating unit regulates the flow of cooling water such that cooling water flowing out of the block-side passage and the head-side passage flows into the bypass passage without flowing into the heating heat exchanger.

11. The cooling system according to claim 1, wherein the heating heat exchanger is configured to exchange heat between cooling water, which is a mixture of cooling water flowing out of the block-side passage and cooling water flowing out of the head-side passage, and the blown air.

12. The cooling system according to claim 1, wherein the heating heat exchanger includes:

a first heat exchanging part that is configured to exchange heat between the blown air and cooling water flowing out of the head-side passage; and a second heat exchanging part that is configured to exchange heat between the blown air passing through the first heat exchange part and cooling water flowing out of the block-side passage.

13. The cooling system according to claim 1, wherein:

the flow regulating unit includes a first flow regulating valve where cooling water flowing out of the block-side passage is divided between cooling water flowing toward the bypass passage and cooling water flowing toward the heating heat exchanger; and the first flow regulating valve is configured to regulate a flow rate of cooling water flowing out toward the bypass passage and a flow rate of cooling water flowing out toward the heating heat exchanger.

14. The cooling system according to claim 13, wherein:

the flow regulating unit includes a second flow regulating valve where cooling water flowing out of the head-side passage is divided between cooling water flowing toward the bypass passage and cooling water flowing toward the heating heat exchanger; and the second flow regulating valve is configured to regulate a flow rate of cooling water flowing out toward the bypass passage and a flow rate of cooling water flowing out toward the heating heat exchanger.

15. The cooling system according to claim 1, further comprising a heating request input unit configured to make a request to heat the blown air through operation thereof by a user of the cooling system, wherein the heating request includes the request to heat the blown air through the operation of the heating request input unit.

16. The cooling system according to claim 1, wherein the heating request includes an outside air temperature being equal to or lower than a predetermined base outside air temperature.

17. The cooling system according to claim 1, wherein the heating request includes an inside air temperature in the air-conditioning target space being equal to or lower than a predetermined base inside air temperature.

* * * * *